US006447903B1

(12) United States Patent
Bernaschek

(10) Patent No.: US 6,447,903 B1
(45) Date of Patent: Sep. 10, 2002

(54) MULTILOBAL HOLLOW FILAMENTS HAVING STIFFENING RIBS AND STIFFENING WEBS

(75) Inventor: Walter Bernaschek, Beckum (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/763,722

(22) PCT Filed: Aug. 25, 1999

(86) PCT No.: PCT/US99/19610

§ 371 (c)(1),
(2), (4) Date: Feb. 23, 2001

(87) PCT Pub. No.: WO00/12789

PCT Pub. Date: Mar. 9, 2000

(30) Foreign Application Priority Data

Aug. 27, 1998 (EP) ..... 98116225

(51) Int. Cl.[7] ..... D01F 6/00
(52) U.S. Cl. ..... 428/376; 428/397; 428/398
(58) Field of Search ..... 428/376, 398, 428/397

(56) References Cited

U.S. PATENT DOCUMENTS

| | | | | |
|---|---|---|---|---|
| 2,965,925 A | | 12/1960 | Dietzsch | |
| 3,493,459 A | | 2/1970 | McIntosh et al. | |
| 4,279,053 A | * | 7/1981 | Payne et al. | 428/398 |
| 4,407,889 A | * | 10/1983 | Gintis et al. | 428/398 |
| 4,492,731 A | | 1/1985 | Bankar et al. | |
| 4,648,830 A | | 3/1987 | Peterson et al. | |
| 4,770,938 A | | 9/1988 | Peterson et al. | |
| 5,125,818 A | | 6/1992 | Yeh | |
| 5,168,143 A | | 12/1992 | Kobsa et al. | |
| 5,190,821 A | | 3/1993 | Goodall et al. | |
| 5,208,107 A | | 5/1993 | Yeh et al. | |
| 5,322,736 A | | 6/1994 | Boyle et al. | |
| 5,334,452 A | | 8/1994 | Yu | |
| 5,380,592 A | * | 1/1995 | Tung | 428/397 |
| 5,523,155 A | * | 6/1996 | Lin et al. | 428/376 |
| 5,869,181 A | * | 2/1999 | Kent et al. | 428/398 |
| 6,048,615 A | * | 4/2000 | Lin et al. | 428/397 |

FOREIGN PATENT DOCUMENTS

| | | |
|---|---|---|
| EP | 0201812 | 5/1986 |
| EP | 0516119 | 5/1992 |
| EP | 0661391 | 12/1994 |
| WO | WO 94/13869 | 6/1994 |

* cited by examiner

*Primary Examiner*—N. Edwards

(57) ABSTRACT

The present invention relates to a multi-lobal hollow filament having stiffening ribs in the core portion and at least one transverse web in each lobe.

8 Claims, 28 Drawing Sheets

MULTILOBAL HOLLOW FILAMENTS HAVING STIFFENING RIBS AND STIFFENING WEBS

BACKGROUND OF THE INVENTION

1. Field of the Invention

The present invention relates to a multi-lobal hollow filament having stiffening ribs in the core portion and at least one transverse web in each lobe, and to a spinneret plate for producing the filament.

2. Description of the Prior Art

Fibers useful for carpet manufacture exhibit certain desirable performance criteria. These criteria include good crush resistance, high cover and good soil hiding ability. The structure of the fiber is a determinative factor in the ability of a given fiber to meet these performance criteria.

The crush resistance of a carpet depends on the stability properties of the pile fibers used in the carpet. The higher the stability of the fiber, the more resistant to crushing is the carpet. The covering ability of a carpet is determined by the space occupied by the fiber cross-section. For a given crimp a measure of the space occupancy for a lobal fiber is given by the fiber's modification ratio. The higher the modification ratio of the fiber, the greater the covering ability of the carpet.

The presence of hollow regions in the interior of the fiber further increases the covering power and simultaneously increases its light scattering ability and decreases its luster. Thus, the presence of hollow regions coupled with the modification ratio, determine the fiber's covering and soil hiding ability. U.S. Pat. No. 5,380,592 (Tung) and European Patent Office Publication 661,391 disclose a trilobal or tetralobal filament having a hollow core portion and an axially extending void in each lobe.

In another aspect hollow fibers with the same modification ratio and surface area as against solid fibers reduce the specific gravity according to the percentage of the fiber that is hollow. For example, a twenty percent hollow (or "void") ratio reduces the specific gravity or density for nylon fibers from 1.14 to 0.91 grams per cubic centimeter and reduces the specific gravity for polyester fibers from 1.35 to 1.08 grams per cubic centimeter (both twenty percent reductions). This is desirable for lightweight carpets, apparel or fabrics.

Designing the structure of the fiber to enhance one of these performance criteria is often detrimental to another performance criterion. For example, in U.S. Pat. No. 5,208,107 (Yeh et al.), a multi-lobal synthetic fiber has a single axially extending central void. Although this structure may enhance the fiber's stability it is not well-suited to enhance the soil hiding ability of the fiber.

As another example, U.S. Pat. No. 4,770,938 (Peterson et al.) shows a trilobal fiber having elongated voids extending through each lobe. Although such a structure increases the soil hiding capability of the fiber the lack of rigidity makes the lobes prone to collapse, thus detracting from the crush resistance of the fiber. If the structure of the lobes were rigidified as in U.S. Pat. No. 5,322,736 (Boyle et al.) the fiber becomes more crush resistant, at the cost of increased polymer.

In view of the foregoing, it is believed advantageous to provide a multi-lobal fiber structure that optimizes the fiber's soil hiding and covering ability, without sacrificing crush resistance and without increasing the volume of the polymer material in the fiber.

SUMMARY OF THE INVENTION

The present invention is directed to a thermoplastic synthetic polymer filament comprising a core portion having a number N lobes joined thereto. Preferably, three or four. lobes may be provided, thereby respectively defining trilobal and tetralobal filament configurations. Each lobe has a tip thereon and is joined to the core portion along an inscribing circle. The filament has a central axis extending therethrough. N stiffening ribs are formed in the core portion, with the ribs extending radially inwardly toward the axis of the filament. The stiffening ribs cooperate to define at least N hollow regions in the core portion. Each hollow region in the core aligns radially with a respective lobe.

In one embodiment the radially inner ends of the stiffening ribs may be spaced from each other and from the central axis of the filament, thereby to define passages within the core portion through which the hollow regions communicate with each other. Alternatively, each stiffening rib may extend to meet and join to the other of the ribs along the axis of the filament whereby the hollow regions in the core portion are isolated from each other. The ribs in the core portion form abutting members on the interior of the filament that contact with each other under high face loading to enhance the stiffness and load capacity of the filament.

Each lobe has at least one opening disposed between the tip of the lobe and the inscribing circle. The opening in each lobe and the hollow region of the core portion corresponding to that lobe cooperate to define a transverse stiffening web across each lobe. The presence of the transverse stiffening web across each lobe prevent the lobe lateral edges from being deformed towards the exterior of the filament, resulting in a high degree of rigidity and crush resistance.

In accordance with another modified embodiment each lobe may be provided with a second opening therein so that the first and the second openings cooperate to define a second transverse web extending across the lobe. When provided the second opening in each lobe is disposed between the first opening and the tip of the lobe.

In yet another embodiment the major portion of each lateral edge of each lobe may be substantially linear over substantially its entire length. The arm angle for linear edge filament lies in the range from about zero to about fifteen degrees. Alternatively, the major portion of each lateral edge is convexly curved over substantially its entire length.

Any filament in accordance with any of the various embodiments of the invention illustrated herein has a modification ratio that lies in the range from about 1.6 to about 4.0, and preferably in the range from about 2.0 to 3.0, and most preferably in the range from about 2.3 to about 2.6. The filaments have a total void percentage in the range from about seven (7%) to about thirty percent (30%), and more preferably, in the range from about twelve (12%) to about twenty-two percent (22%).

In another aspect the present invention is directed to a spinneret plate for producing any of the thermoplastic synthetic polymer filaments summarized above. The spinneret plate comprises a cluster of N pairs of peripheral slot segments centered about a central point. To form lobes having substantially linear or convexly curved lateral edges, the peripheral slot segments are either substantially linear or convexly curved, respectively.

Each peripheral slot segment in each pair is joined to an adjacent peripheral slot segment at a junction point. A rib-forming slot extends radially inwardly from each junction point toward the central point of the cluster. The distance between the junction point and the central point of the cluster occupied by each rib-forming slot determines whether the ribs meet at the axis or whether the inner ends of the ribs are spaced from the axis.

Each slot segment in each pair is confrontationally disposed with respect to a slot segment in another pair. At least one web-forming slot extends from each peripheral slot segment toward the peripheral slot segment with which it is confrontationally disposed. If desired, a second web-forming slot may also extend from each peripheral slot segment toward the confrontationally disposed peripheral slot segment.

BRIEF DESCRIPTION OF THE DRAWINGS

The invention will be more fully understood from the following detailed description, taken in connection with the accompanying drawings, which form a part of this application and in which:

FIG. 5B through FIG. 8B are bottom views of spinneret plates in accordance with the present invention for producing the trilobal filaments of FIGS. 5A through 8A, respectively;

DETAILED DESCRIPTION OF THE INVENTION

Figure 1A:
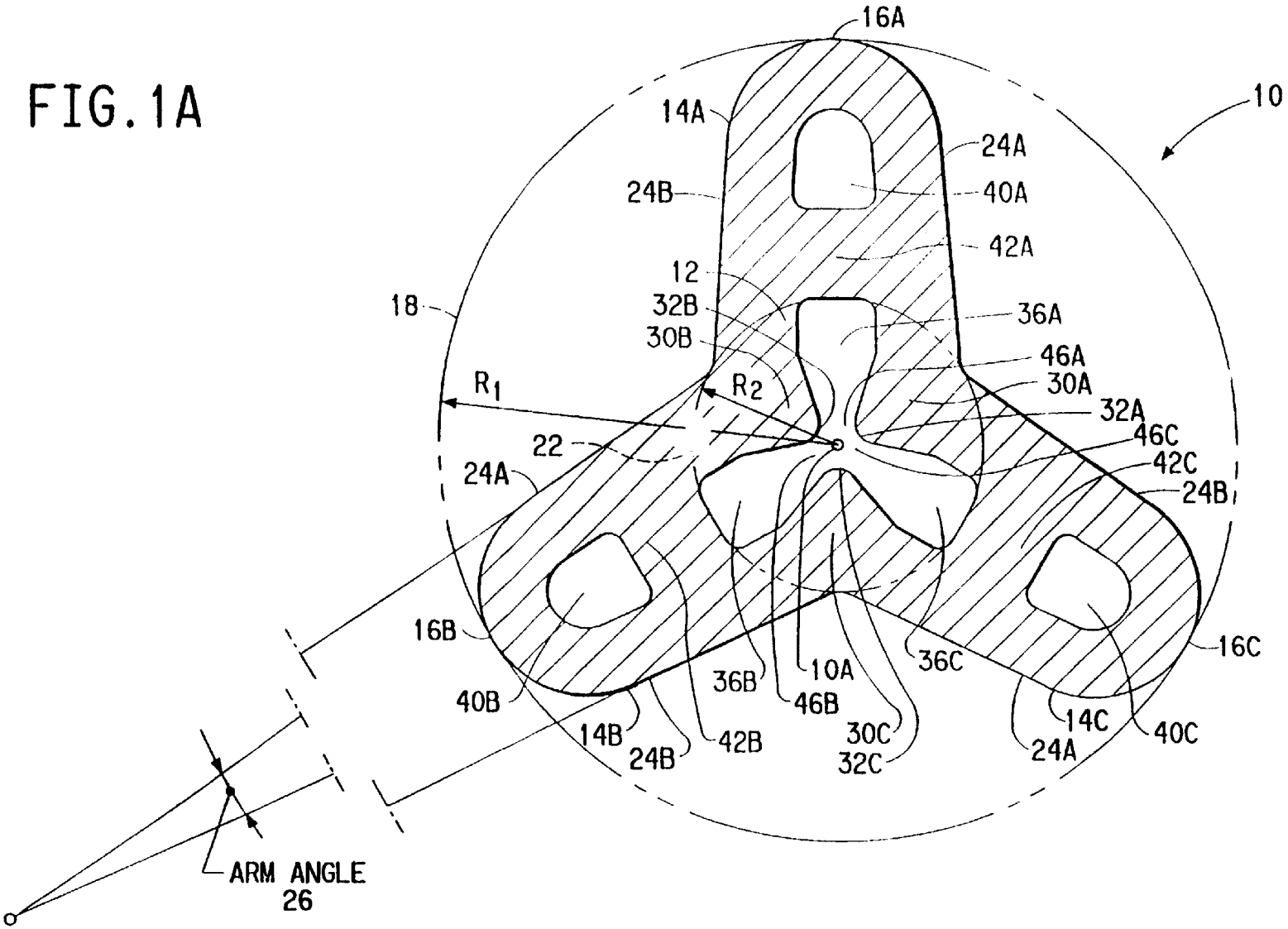
FIG. 1A is a cross section view of a straight-edged trilobal filament in accordance with the present invention in which each lobe has a single transverse stiffening web and a single opening therein and in which the hollow regions of the core portion communicate through constricted passages defined by the stiffening ribs.

Throughout the following detailed description similar reference numerals refer to similar elements in all Figures of the drawings.

Filament

FIG. 1A is a cross section view of a trilobal thermoplastic synthetic polymer filament generally indicated by the reference character 10 in accordance with the present invention. A filament in accordance with the present invention may be prepared using any synthetic, linear, thermoplastic melt-spinnable polymer, including polyamides, polyesters, and polyolefins. After melting the polymer is extruded ("spun") through a spinneret plate (to be described hereinafter) under conditions which vary depending upon the individual polymer and the particular filament being spun thereby to produce a filament having a desired denier and a desired void percentage. Void percentage can be increased by a more rapid quenching and increasing the melt viscosity, which can slow the flow allowing sturdy, pronounced molding to occur.

The filament 10 shown in FIG. 1A has a central core portion 12 having three lobes 14A, 14B, and 14C joined thereto (i. e., the number N=three). An axis 10A extends centrally and axially through the core portion 12 of the filament 10. Each lobe 14A, 14B, 14C terminates in a generally rounded tip 16A, 16B, 16C, respectively.

The tips 16A, 16B, 16C of each lobe 14A, 14B, 14C lie on a circumscribing circle 18 having a radius $R_1$ centered on the axis 10A. The junction between each lobe 14A, 14B, 14C and the core portion 12 lies on an inscribing circle 22 having a radius $R_2$ centered on the axis 10A. The modification ratio (i. e., the ratio of the radius $R_1$ to the radius $R_2$) of the filament 10 is in the range from about 1.6 to about 4.0, more preferably in the range from about 2.0 to 3.0, and most preferably in the range from about 2.3 to about 2.6.

The major portion of each lateral edge 24A, 24B of each lobe 14A, 14B, 14C is substantially linear to impart a substantially "straight" appearance over substantially the entire length between the tip 16A, 16B, 16C and the joint of the respective lobe 14A, 14B 14C to the core portion 12. The lateral edges 24A, 24B of each lobe 14A, 14B, 14C converge toward each other to define an arm angle 26 for each lobe 14A, 14B, 14C. The arm angle 26 lies in the range from about zero to about fifteen (15°) degrees.

The core portion 12 has three stiffening ribs 30A, 30B, 30C formed therein. The ribs 30A, 30B, 30C lie within the inscribing circle 22 and extend within the core portion 12 in a radially inward direction toward the axis 10A of the filament. Each rib 30A, 30B, 30C has a respective inner end 32A, 32B, 32C thereon. The ribs 30A, 30B, 30C cooperate to define three hollow regions 36A, 36B, 36C in the core portion 12. The hollow regions 36A, 36B, 36C extend axially through the filament 10. Each hollow region 36A, 36B, 36C aligns radially (with respect to the central axis 10A) with a respective lobe 14A, 14B, 14C.

In accordance with the present invention each lobe 14A, 14B, 14C has at least one opening 40A, 40B, 40C, respectively, therein. The opening 40A, 40B, 40C in each respective lobe 14A, 14B, 14C is disposed between the lobe tip 16A, 16B, 16C and the inscribing circle 22. The openings 40A, 40B, 40C also extend axially through the filament 10. The opening 40A, 40B, 40C together with the hollow region 36A, 36B, 36C corresponding to the lobe cooperate to define a transverse stiffening web 42A, 42B, 42C extending across the lobe.

In the embodiment of the invention illustrated in FIG. 1A the radially inner ends 32A, 32B, 32C of adjacent stiffening ribs 30A, 30B, 30C are spaced from each other and from the central axis 10A of the filament 10. The spacing between the inner ends 32A, 32B, 32C of adjacent ribs 30A, 30B, 30C defines passages 46A, 46B, 46C through which the hollow regions 36A, 36B, 36C may communicate with each other. In the embodiment illustrated the transverse dimension of the passages 46 is relatively constricted with respect to the transverse dimension of the associated hollow region 36, although such a relationship is not required.

In the embodiment shown in FIG. 1A the hollow regions 36A, 36B, 36C and the passages 46A, 46B, 46C form a unitary void that extends centrally and axially through the core portion 12 of the filament 10. The relatively constricted shape of the passages 46A, 46B, 46C as compared to the hollow regions 36A, 36B, 36C imparts a generally "clover-like" or "propeller-like" shape to the unitary void.

The presence of the openings 40A, 40B, 40C together with the unitary central axial void formed by the hollow regions 36A, 36B, 36C and the passages 46A, 46B, 46C results in a filament 10 in which the cross section has a total void percentage (herein also "void%"; i. e., the percentage of "open space" on the interior of the filament) that lies in the range from about seven (7%) to about thirty percent (30%). More preferably, the total void percentage lies in the range from about twelve (12%) to about twenty-two percent (22%). As will be demonstrated by the Examples following herein the filament 10 in accordance with the present invention embodies various structural compromises that result in acceptable performance as measured against all desirable performance criteria. The modification ratio, arm angle and void percentage cooperate to impart high cover, low glitter and good soil hiding performance to the filament 10. The stiffening web 42 in each lobe 14 retards the collapse of the lobe due to high force loading, while the ribs 30A, 30B, 30C in the core portion 12 form abutting members on the interior of the filament that contact with each other under high face loading to enhance the stiffness and load capacity of the filament. The presence of these structural features imparts good crush resistance to the filament.

Spinneret Plate

Figure 1B:
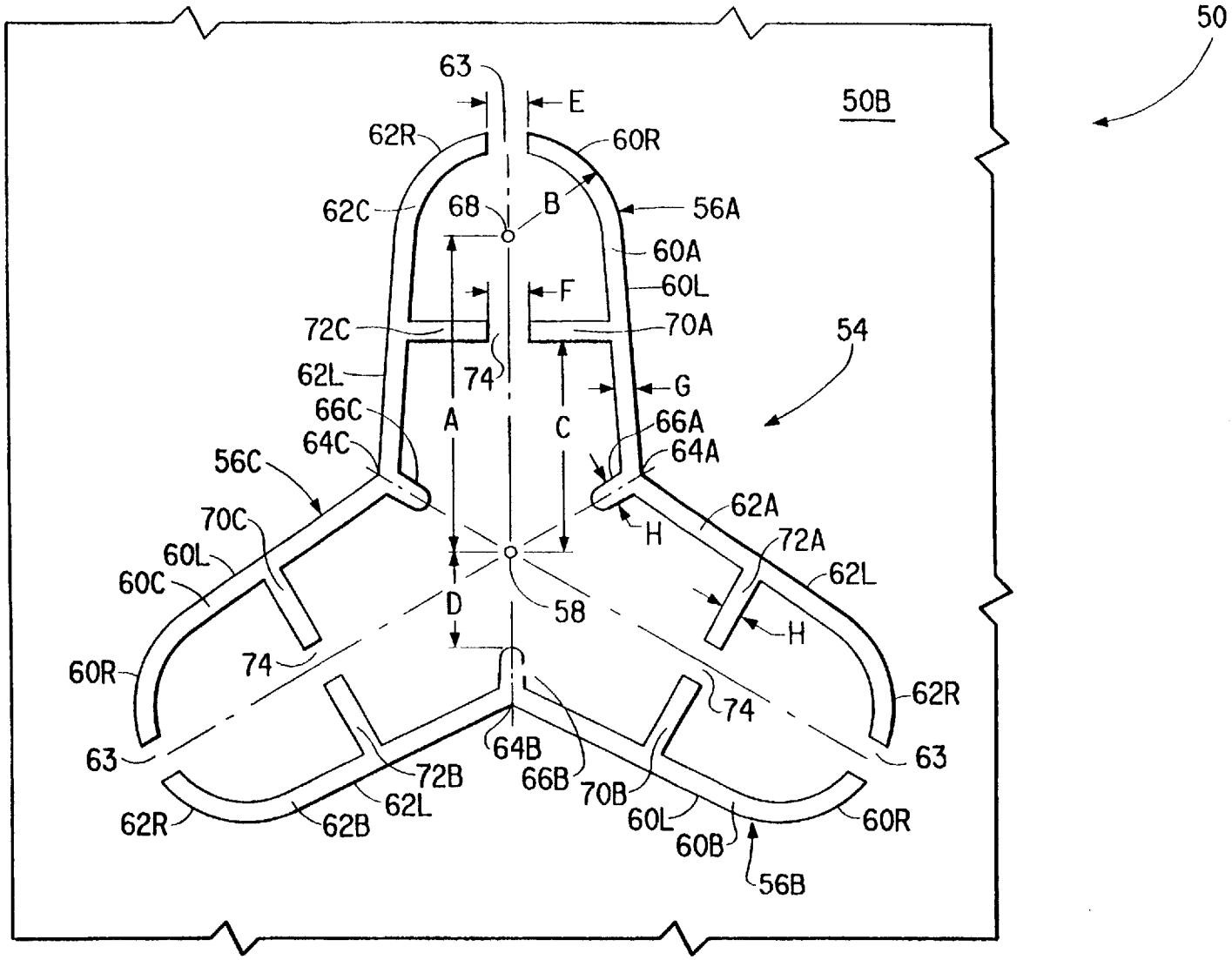
FIG. 1B is a bottom view of a spinneret plate in accordance with the present invention for producing the straight-edged trilobal filament of FIG. 1A.

FIG. 1B illustrates the bottom surface 50B of a portion of a spinneret plate 50 for producing the filament 10 depicted in FIG. 1A. As is known in the art a spinneret plate 50 is a relatively massive member having an upper surface and the bottom surface 50B. The upper surface of the spinneret plate is provided with a recess (not shown) whereby connection of the plate 50 to a source of polymer may be effected. Depending upon the rheology of the polymer being used the lower margins of the recess may be inclined to facilitate flow of polymer from the supply to the spinneret plate.

A capillary arrangement generally indicated by the reference character 54 extends through the plate 50 from its recessed upper surface to the bottom surface 50B. As is seen in FIG. 1B the capillary arrangement 54 is defined by a cluster of peripheral slots 56A, 56B, 56C centered about a central point 58. Each peripheral slot 56A, 56B, 56C itself comprises a pair of slot segments indicated generally by the characters 60, 62. Thus, the peripheral slot 56A includes paired slot segments 60A, 62A; the peripheral slot 56B includes paired slot segments 60B, 62B; while the peripheral slot 56C includes paired slot segments 60C, 62C.

Each slot segment 60 is joined to its paired slot segment 62 at a junction point 64. A rib-forming slot 66 extends from each junction point 64 toward the central point 58 of the cluster. Each slot segment 60, 62 includes a generally linear portion 60L, 62L extending from the junction point 64 toward a generally rounded free end 60R, 62R. This arrangement serves to form the lobes 14 having linear lateral edges with generally rounded tips. The radius of the rounded free ends 60R, 62R is centered on an origin 68. Adjacent rounded ends 60R, 62R are spaced by a gap 63.

Each slot segment 60, 62 in a peripheral slot 56A, 56B, 56C is confrontationally disposed with respect to a slot segment forming another peripheral slot. Thus, in FIG. 1B, the slot segment 60A included in the peripheral slot 56A is confrontationally disposed with respect to the slot segment 62C included in the peripheral slot 56C. The slot segment 62A included in the peripheral slot 56A is confrontationally disposed with respect to the slot segment 60B in the peripheral slot 56B. Similarly, the slot segment 62B included in the peripheral slot 56B is confrontationally disposed with respect to the slot segment 60C included in the peripheral slot 56C.

The distance between the junction point 64 and the central point 58 of the cluster occupied by each rib-forming slot 66 determines whether the radially inner end 32A, 32B, 32C of respective stiffening ribs 30A, 30B, 30C are joined together or are spaced from each other and from the central axis 10A of the filament 10 (as in FIG. 1A). In general, to insure that the inner ends of the ribs join along the axis (and thus serve to isolate the hollow regions in the core portion from each other), the rib-forming slots should extend at least two-thirds of the distance between the junction point and the central point of the cluster. On the other hand, if the rib-forming slots extend less than one-half of the distance between the junction point and the central point of the cluster, then the inner ends of the ribs are spaced from each other and from the axis. If the rib-forming slots extend at least one-half but less than two-thirds of the distance between the junction point and the central point of the cluster, then the viscosity determines whether the ribs will join together at the axis of the filament.

Web-forming slots 70, 72 are provided on each peripheral slot segment 60, 62, respectively The web-forming slot 70, 72 on any given slot segment 60, 62 extends toward a corresponding web-forming slot 70, 72 (as the case may be) provided on the slot segment 60, 62 with which the given slot segment is confrontationally disposed. The inside ends of the web-forming slots 70, 72 are separated by a space 74.

On FIG. 1B (and on all of the other views of spinneret plates discussed herein) alphabetic reference characters are used to indicate the dimensions of various features of the spinneret plate 50 that form congruent features of the filament 10 of FIG. 1A. In FIG. 1D the character A refers to the distance from the center 58 of the cluster to the origin 68 of the rounded free ends 60R, 62R of the segments 60, 62, while the character B is the dimension of the radius of these free ends 60R, 62R. The character C represents the distance from the central point 58 to the inner wall of each slot 70, 72. The character D represents the spacing between the inner ends of the slots 66. The character E represents the dimension of the gap 63, while the character F represents the dimension of the space 74. The character G represents the width of the peripheral slots 56. The character H denotes the width of the slots 66, 72.

Polymer extruded from the capillary arrangement 54 forms the filament illustrated in FIG. 1A. The presence of the generally linear portions 60L, 62L with generally rounded free ends 60R, 62R serves to form a filament 10 having lobes 14 with linear ("straight") lateral edges 24 and generally rounded tips 16. The spacing between the confronting inner ends of the web-forming slots 70, 72 insures that the polymer merges to complete a web 42 traversing each lobe 14.

Polymer emerging from the slots 66 defines the ribs 32. In FIG. 1B, the rib-forming slots 66 occupy less than one-half of the distance between the junction point 64 and the central point 58 of the cluster, and the inner ends 32 of the stiffening ribs 30 are spaced from each other and from the axis and the hollow regions 36 communicate through the passages 46.

Typical numerical values of the various dimensions indicated by the alphabetic reference characters on FIG. 1B are as follows:

A=0.033", B=0.013", C=0.021", D=0.095",

E=0.0038", F=0.0040", G=0.0022", and H=0.0018".

These dimensions are given all at an arm angle of zero degrees.

Each of the spinneret plates 50 shown herein may be fabricated using the laser technique disclosed in U.S. Pat. No. 5,168,143, (Kobsa et al., QP-4171-A), assigned to the assignee of the present invention.

Figure 2A:
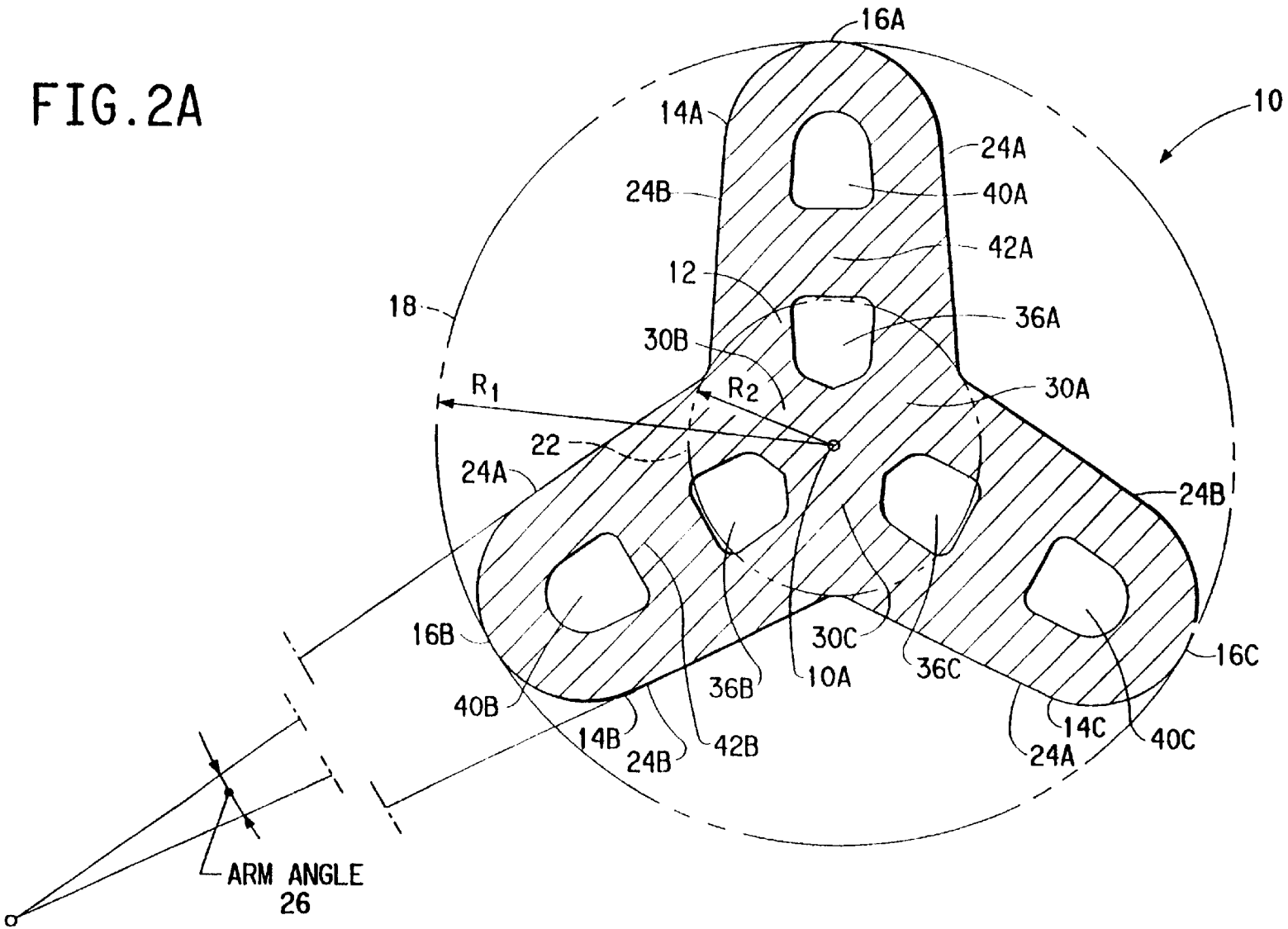
FIG. 2A is a cross section view of a straight-edged trilobal filament generally similar to that shown in FIG. 1A in which the stiffening ribs connect with each other to isolate the hollow regions defined in the core portion.

A modified embodiment of the filament 10 is shown in FIG. 2A. The modified filament 10 of FIG. 2A is identical with that of FIG. 1A in that it exhibits straight lobes with rounded lobe ends. However, the modified filament 10 of FIG. 2A differs from the filament of FIG. 1A in that the hollow regions 36 in the core portion 12 are totally isolated from each other. As is the case with the filament of FIG. 1A the ribs 30 in the core and the stiffening web 42 in each lobe 14 places sufficient material between the hollow regions 36 and the openings 40 to retard crushing of the filament in case of high face loading.

Typical numerical values of the various dimensions indicated by the alphabetic reference characters on FIG. 2B (at an arm angle of zero degrees) are as follows:

A=0.033", B=0.013", C=0.021, D=0.066",

E=00038", F=0.0040", G=0.0022", and H=0.0018".

Particular attention is invited to the magnitude of the dimension D, the distance between the rib forming slots 66 and the center of the cluster 58. In FIG. 1B the dimension D (0.095") is greater than the dimension D in FIG. 2B (0.066"). The rib-forming slots 66 in the spinneret of FIG. 2B extend toward the central point 58 for a distance greater than two-thirds the distance between the junction point 64 and the central point 58 of the cluster. As a result the stiffening ribs 30 of the filament of FIG. 2A join together to isolate the hollow regions 36 from each other. In FIG. 1B the rib-forming slots 66 extend less than one-half the distance between the junction point 64 and the central point 58 of the cluster, so that the ends of the ribs 30 in FIG. 1A are spaced from each other.

Figure 3A:
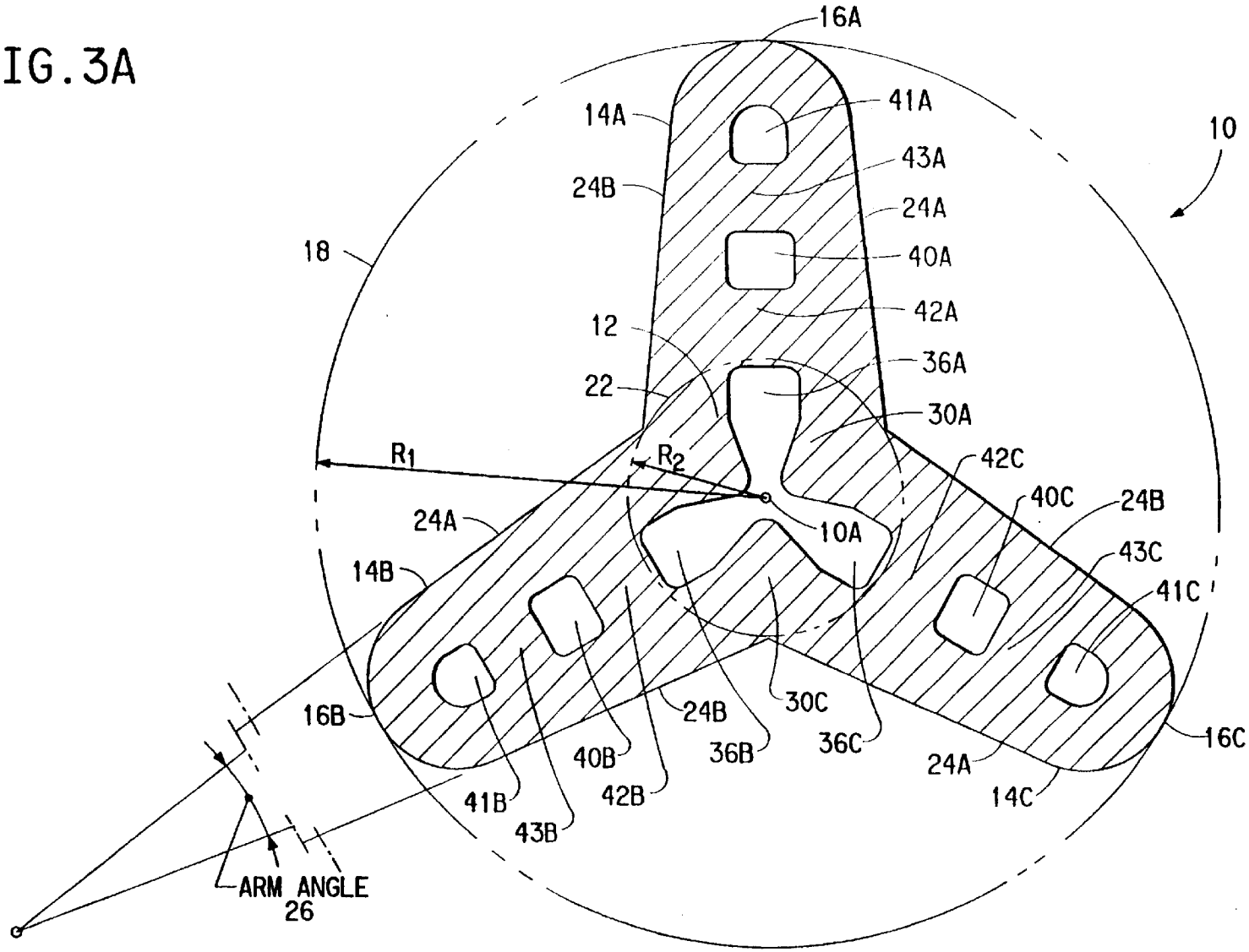
FIG. 3A and FIG. 4A are cross section views analogous to the views shown in FIGS. 1A and 2A, respectively, of straight-edged trilobal filaments in which each lobe has a second transverse stiffening web and a second opening therein.
Figure 4A:
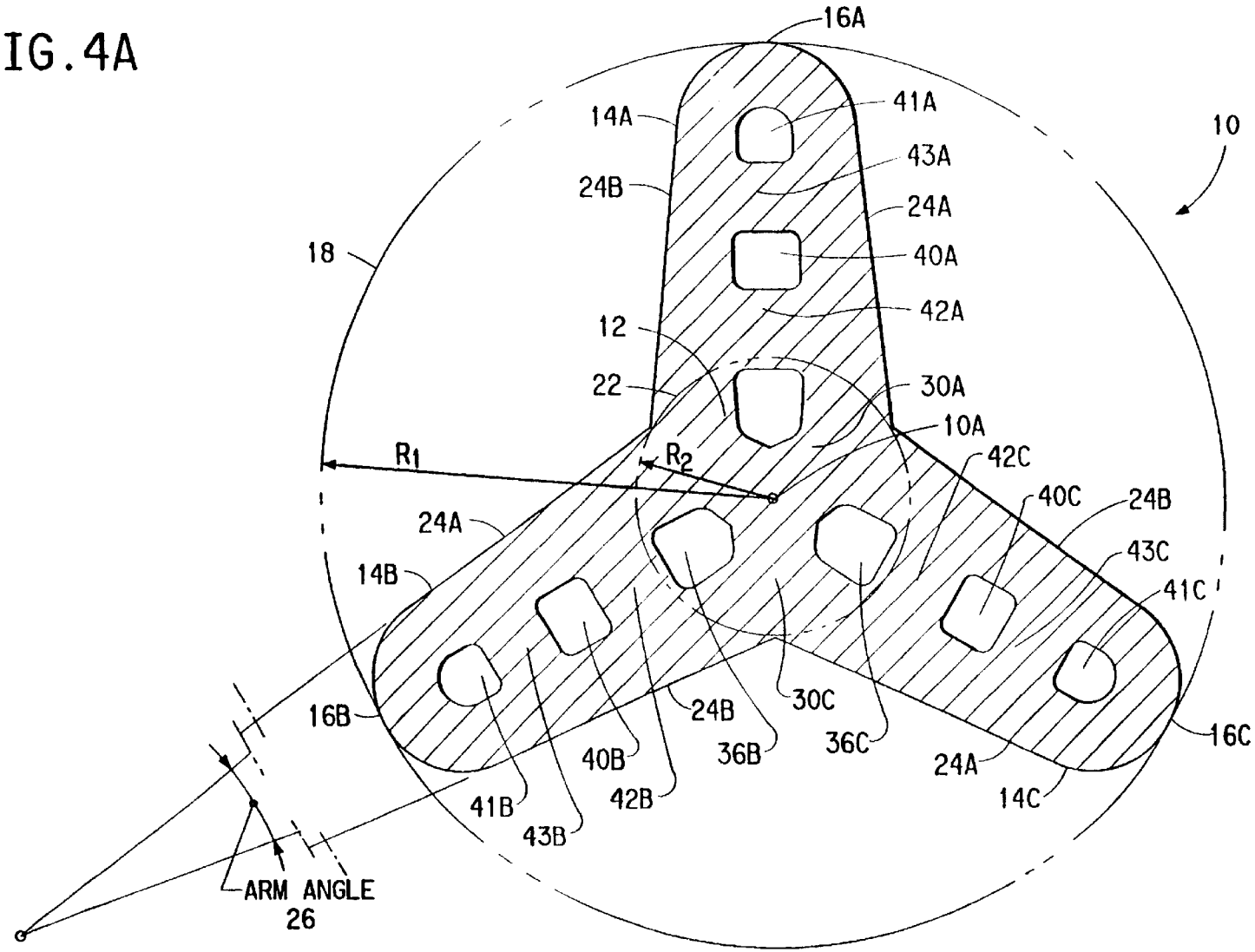

FIGS. 3A and 4A show still other modified embodiments of a filament 10 having straight lobes with rounded ends shown as in FIGS. 1A and 2A. However, the filament of FIG. 3A and FIG. 4A differs from its respective counterparts in FIG. 1A and FIG. 2A by the presence of a second opening 41 in each lobe 14. The second opening 41 is disposed between the first opening 40 and the tip 16 of the lobe 14. In each lobe the first opening 40 and the second opening 41 cooperate to define a second transverse stiffening web 43. The filament of FIGS. 3A and 4A each have sufficient material between the hollow regions 36 and the openings 40 to retard crushing of the filament in case of high face loading.

Figure 3B:
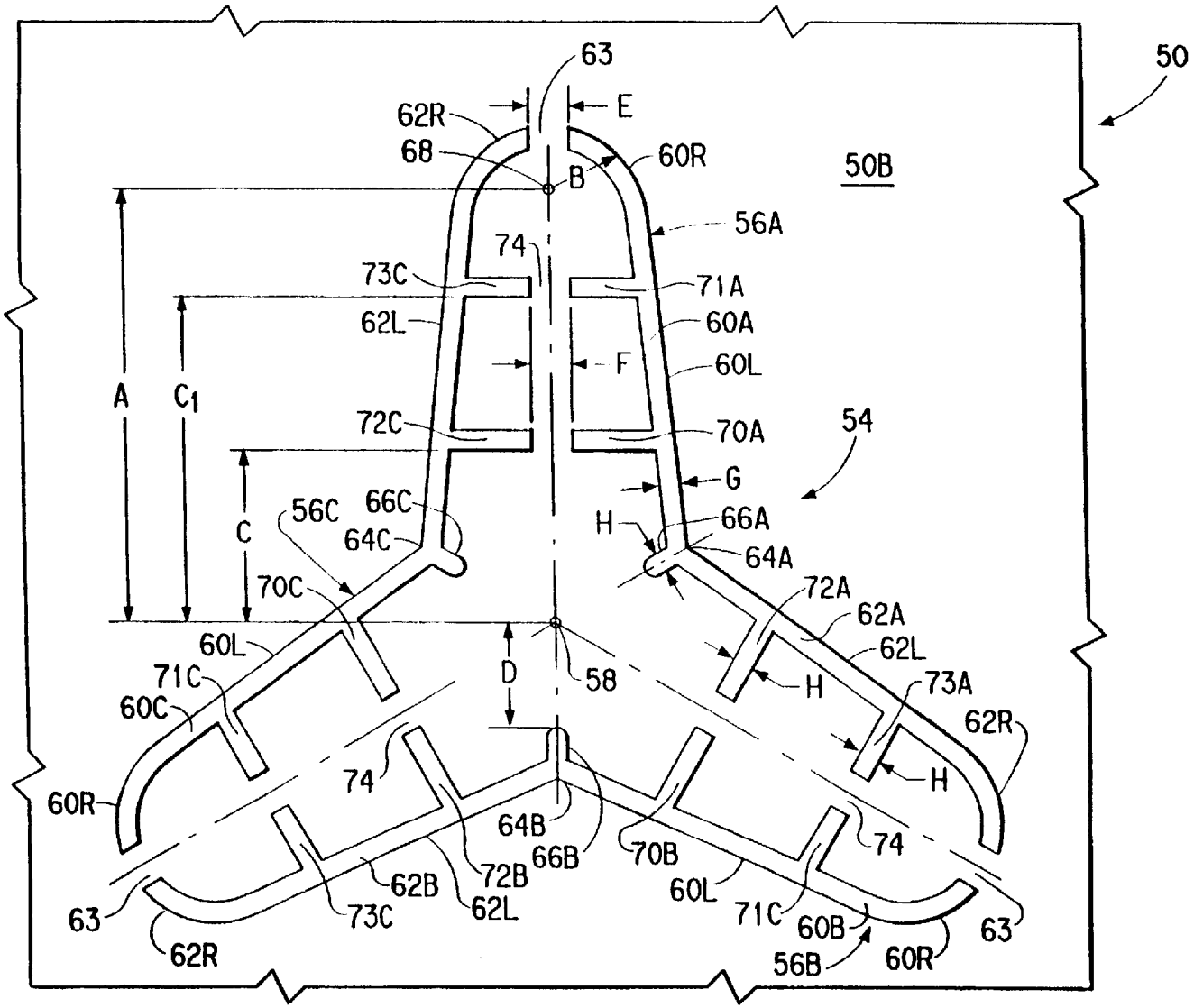
FIG. 3B and FIG. 4B are bottom views of spinneret plates in accordance with the present invention for producing the trilobal filaments of FIGS. 3A and 4A, respectively.
Figure 4B:
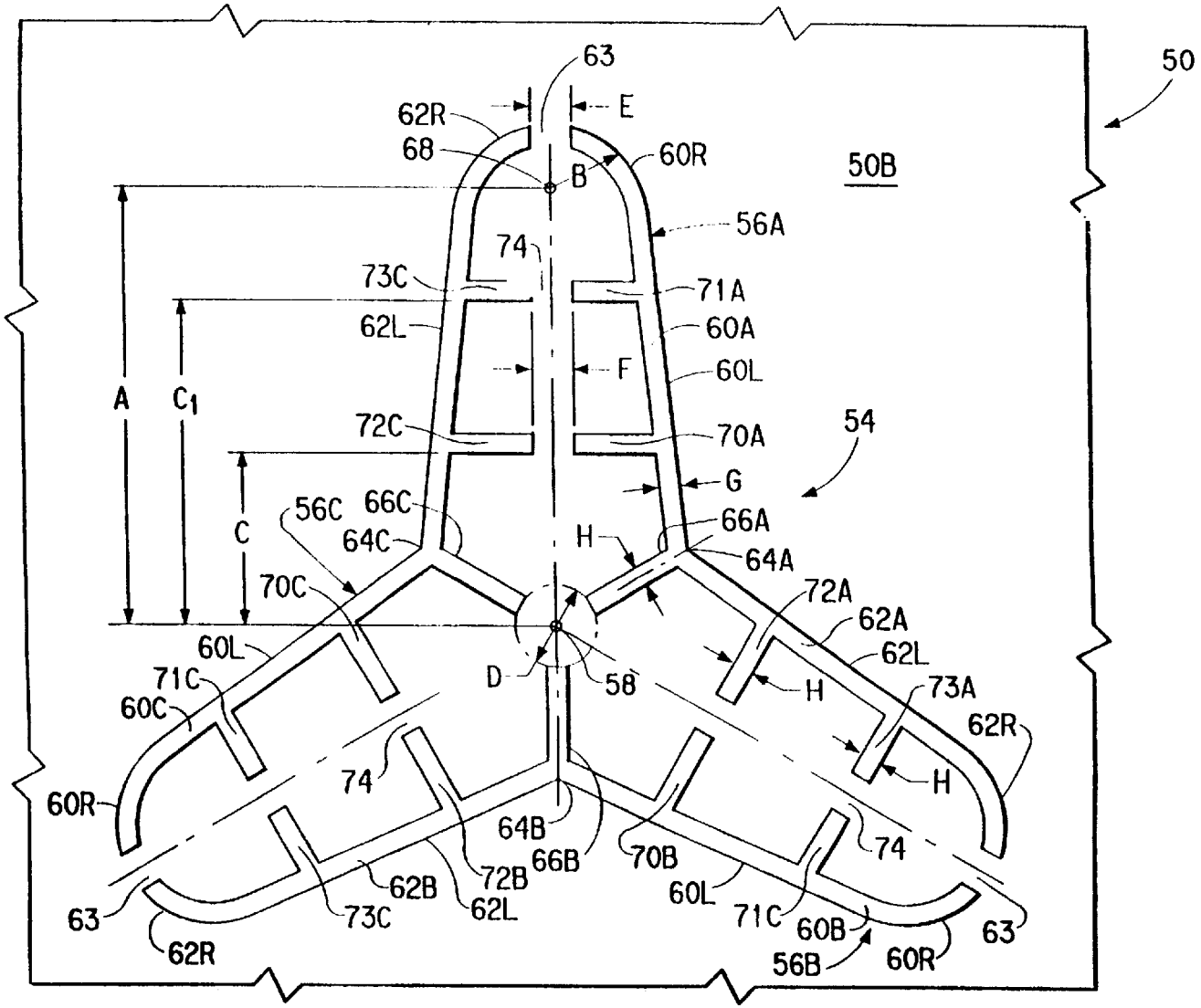

FIGS. 3B and 4B show spinnerets 50 used to produce the congruent filaments illustrated in FIGS. 3A, 4A, respectively. In FIGS. 3B and 4B each slot segment 60, 62, respectively, includes a second web-forming slot 71, 73. The second web-forming slot is located on a slot segment 60, 62 intermediate the first slot 70, 72 (as the case may be) and the free end 60R, 62R. The reference character C1 in these FIGS. 3B, 4B represents the distance from the central point 58 to the inner wall of each second web-forming slot 71, 73.

Typical numerical values of the various dimensions on FIG. 3B (at an arm angle of zero degrees) are as follows:

A=0.047", B=0.013", C=0.038",

C1=0.021", D=0.095", E=0.0038",

F=0.0040", G=0.0022", and H=0.0018"

For FIG. 4B, typical numerical values of the various dimensions (at an arm angle of 0 degree) are:

A=0.047", B=0.013", C=0.038",

C1=0.021", D=0.066", E=0.0038",

F=0.0040", G=0.0022", and H=0.0018"

Figure 2B:
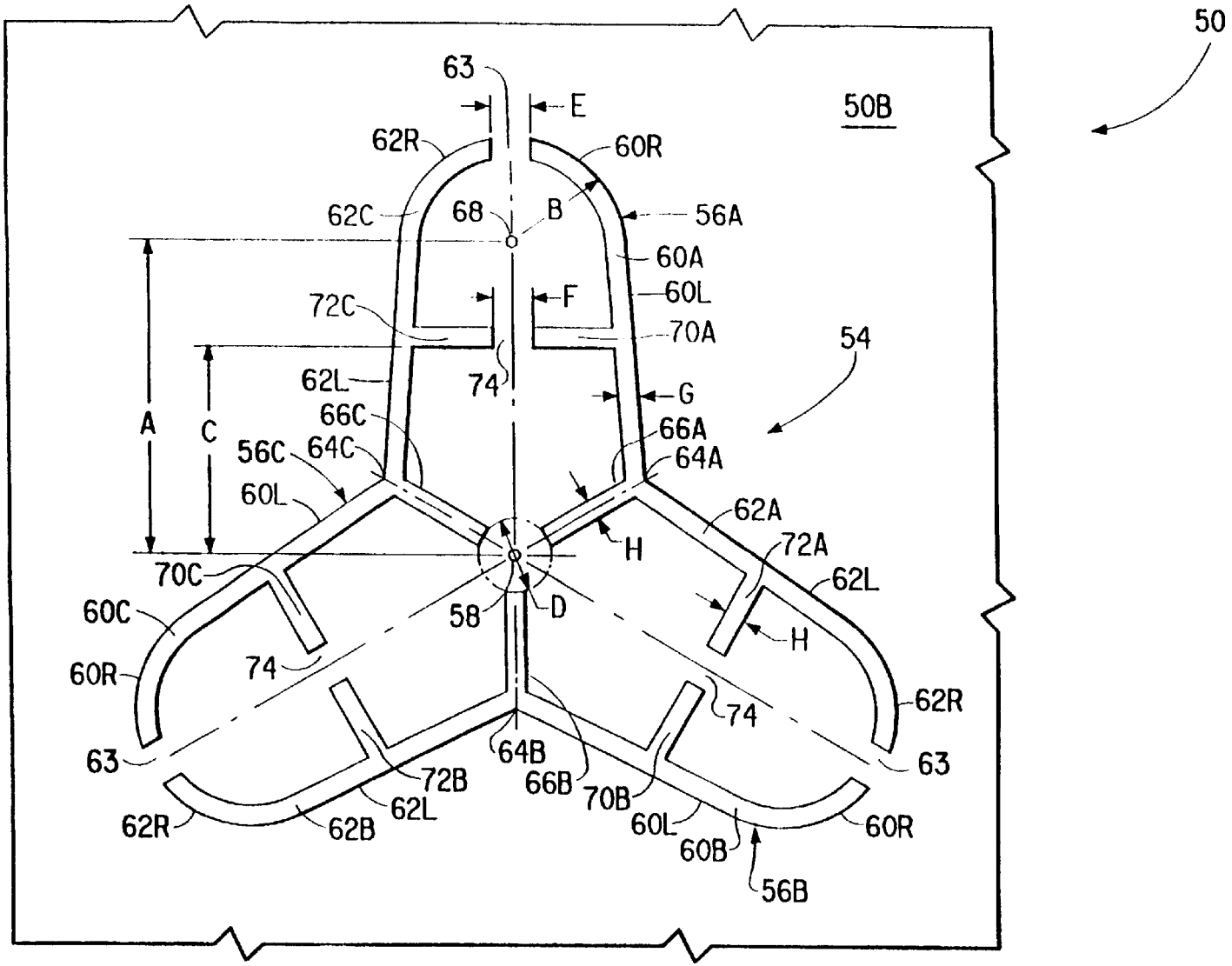
FIG. 2B is a bottom view of a spinneret plate in accordance with the present invention for producing the trilobal filament of FIG. 2A.

However, similar to the situation with the spinnerets of FIGS. 1B and 2B, the dimension D of the rib forming slot 66 is different in FIGS. 3B and 4B. In FIG. 3B the dimension D=0.095", (the slots 66 extend less than one-half the distance between the junction point 64 and the central point 58 of the cluster), thus forming a filament in which the ends of the ribs are spaced from each other (FIG. 3A). In the spinneret of FIG. 4B, the dimension D=0.066" (the slots 66 extend greater than two-thirds the distance between the junction point 64 and the central point 58 of the cluster), so that the inner ends of the ribs 30 contact each other (FIG. 4A).

The filaments 10 shown in FIGS. 5A, 6A, 7A and 8A correspond those of FIGS. 1A and 4A, respectively, save for the configuration of the lobes 14. The filaments of FIGS. 5A, 6A, 7A and 8A each exhibit lobes 14 with convexly curved lateral edges 24 and nipple-shaped lobe ends 16. Each slot segment has rounded portions in the vicinity of the junction point 64 to define concave cusps 25 on the perimeter of the filament between adjacent lobes 14. In accordance with this invention all of these filaments have sufficient material between the lobes to avoid filament crushing under load.

Figure 5A:
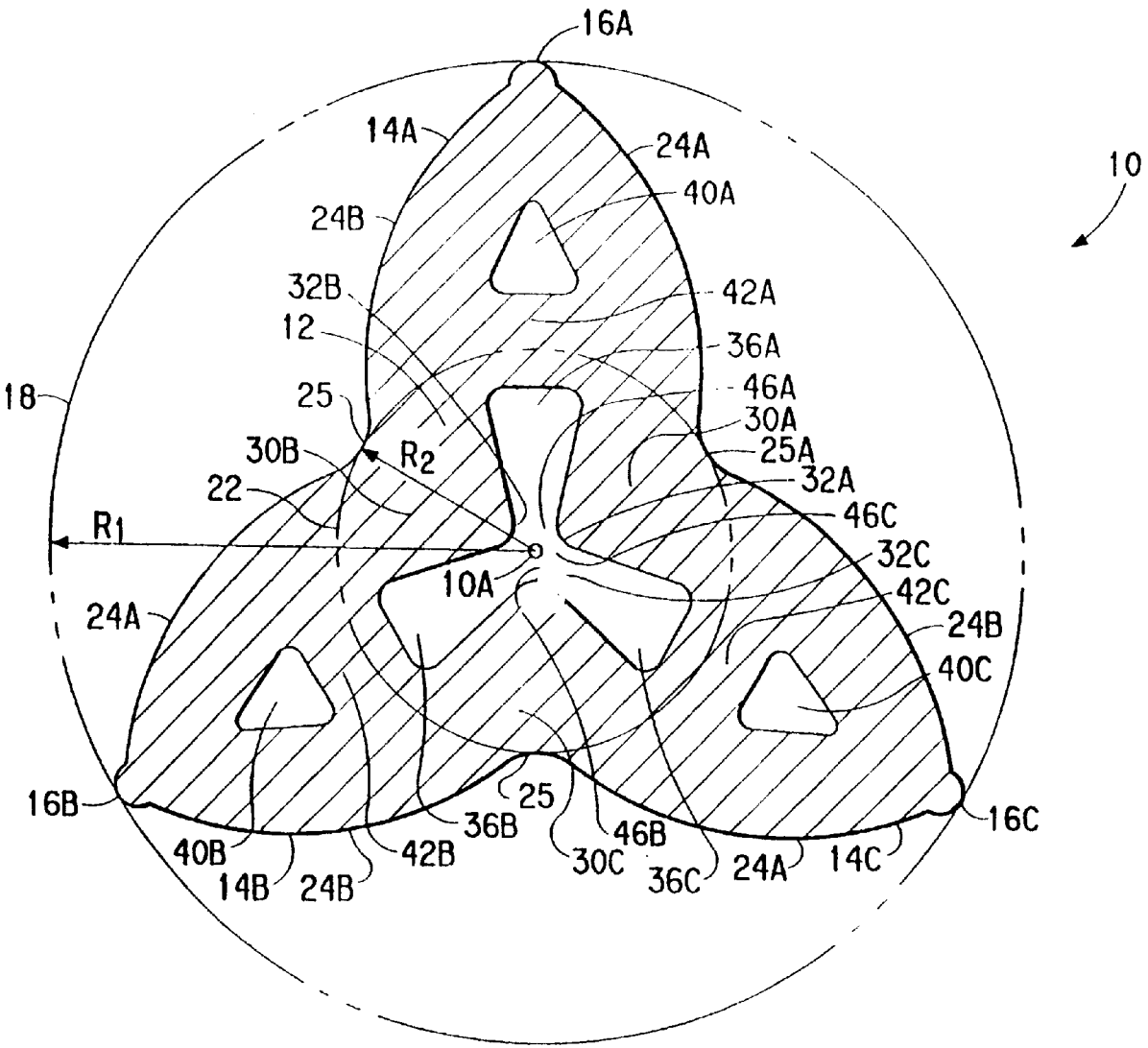
FIG. 5A, FIG. 6A, FIG. 7A and FIG. 8A are each cross section views analogous to the view shown in FIGS. 1A through 4A, respectively, of trilobal filaments in which the lateral edges of each lobe are convexly curved.
Figure 6A:
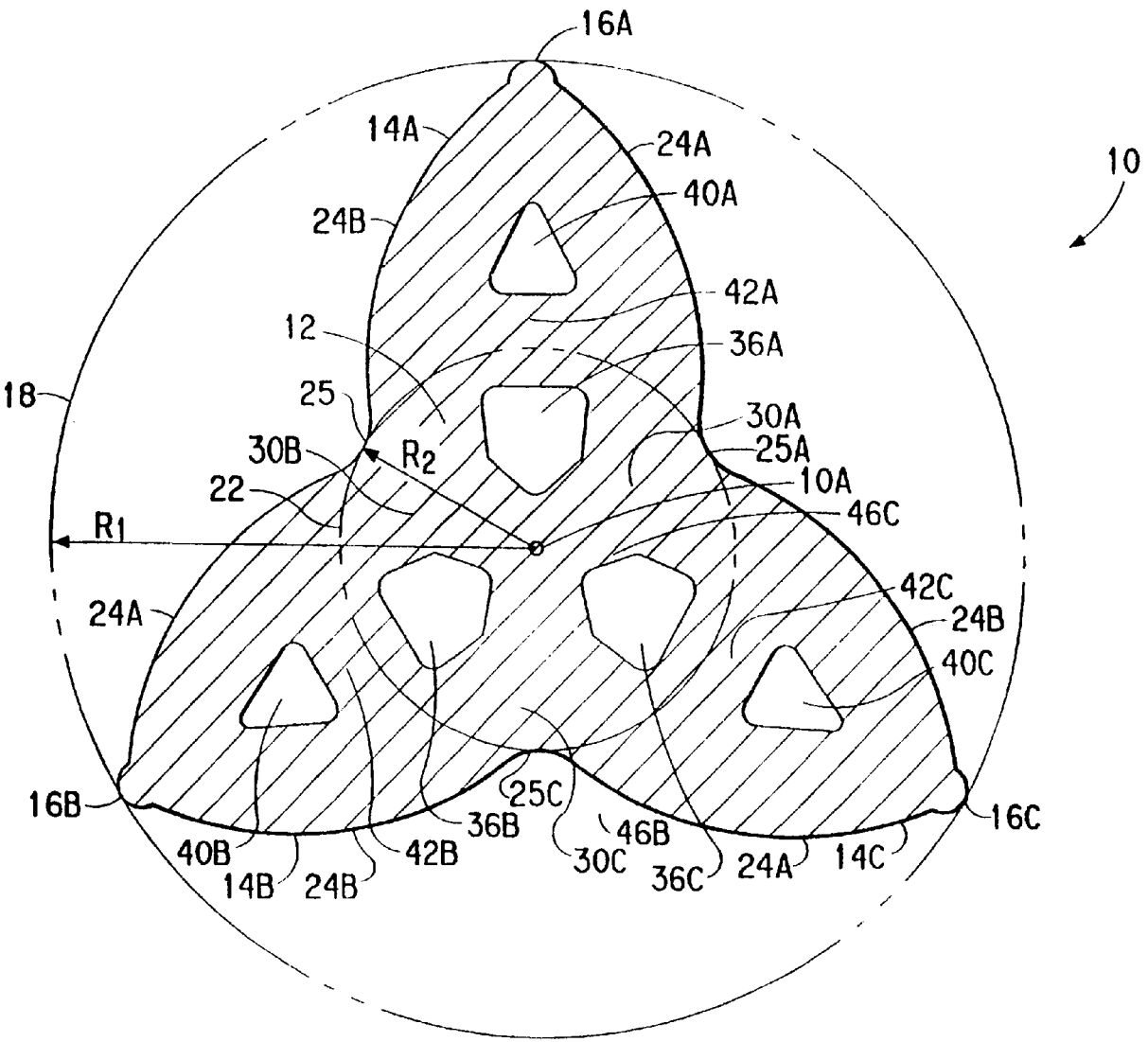

The lobes 14 of the filaments of FIG. 5A and FIG. 6A each have a single stiffening web 42. The core regions 36 in FIG. 5A communicate with each other, while in FIG. 6A the core regions 36 are isolated. The lobes 14 of the filaments of FIG. 7A and FIG. 8A each have a pair of stiffening webs 42, 43. The core regions 36 in FIG. 7A communicate with each other, while in FIG. 8A the core regions 36 are isolated.

Figure 5B:
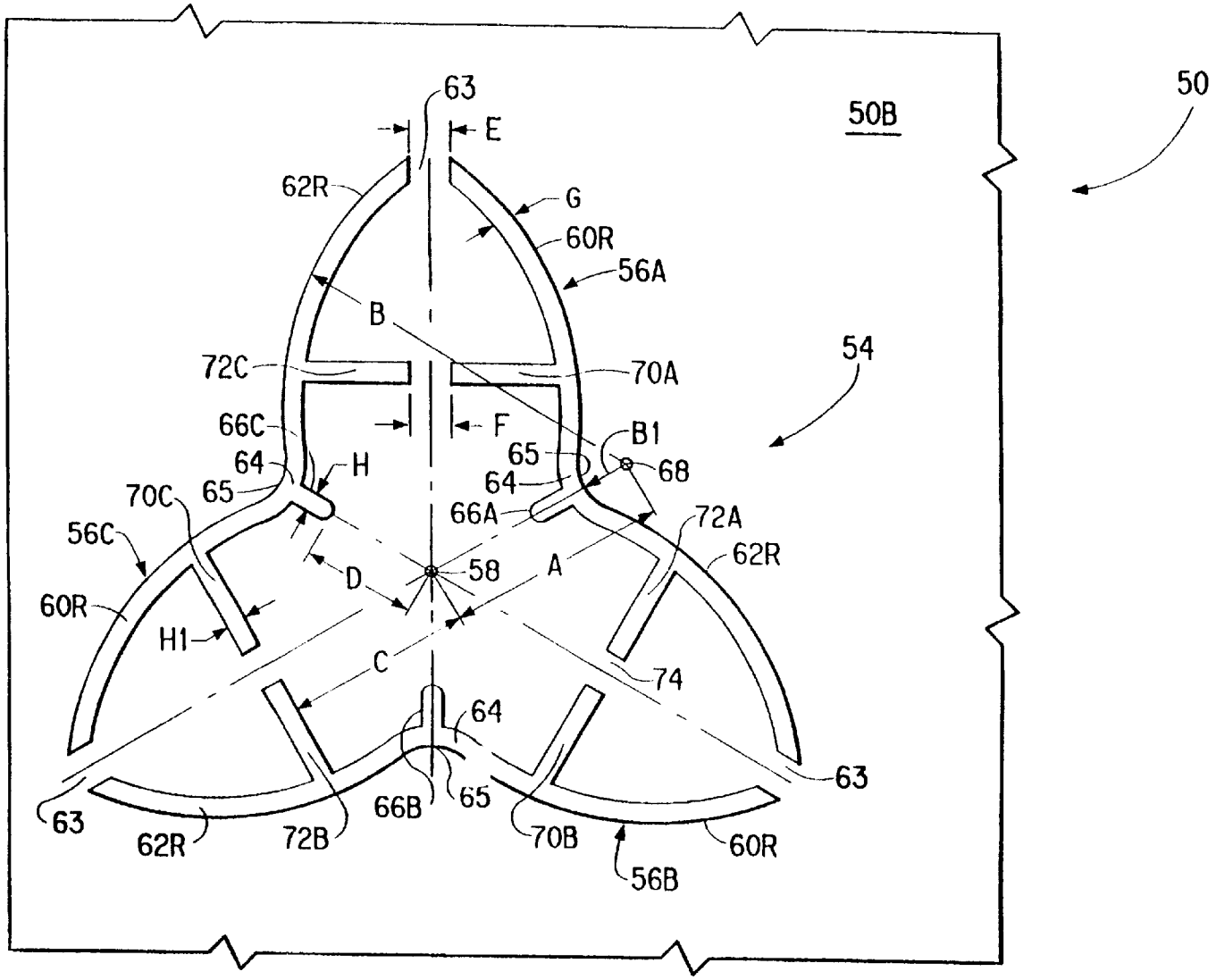
Figure 6B:
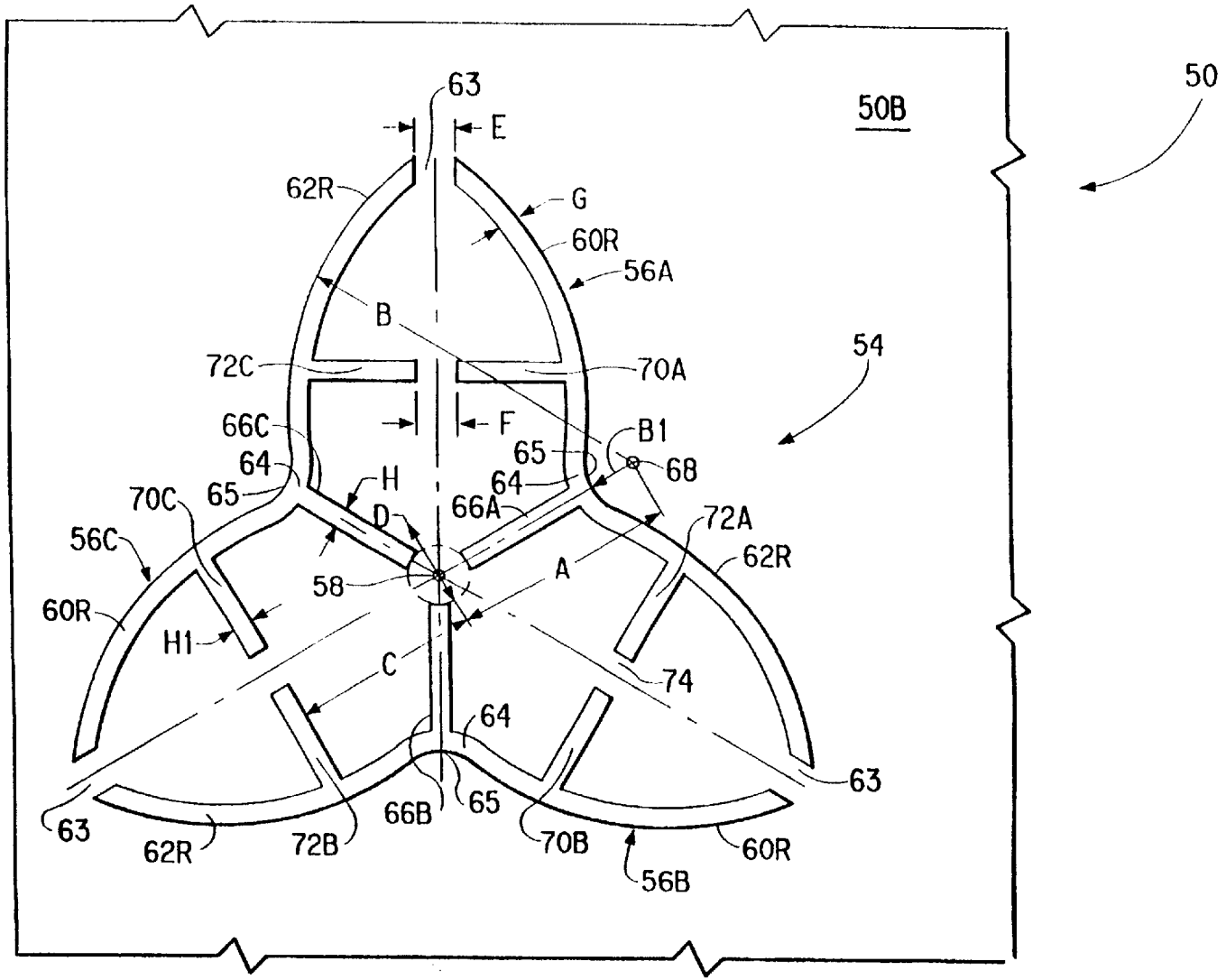

FIGS. 5B and 6B illustrate a spinneret structures corresponding to the filaments of FIGS. 5A and 6A. These spinneret structures are generally similar to those shown earlier except that the linear portions 60L, 62L present in the spinnerets of FIGS. 1B through 4B are omitted. Each slot segment 56 is defined by a rounded or arcuate portion 60R, 62R centered on an origin 68 that corresponds to each of the convexly curved lateral edges of the lobes. Each lobe 14 thus exhibits a configuration reminiscent of a gothic arch. The arcuate portions 60R, 62R are joined in the vicinity of the junction point 64 by a rounded transition region 65 that defines the concave cusps. The reference character A still denotes the distance from the center 58 of the cluster to the origin 68, while the reference characters B and B1 respectively denote the radius of the rounded portions 60R, 62R of the lobes and the radius of the transition region 65. Only one of each such radius is shown for clarity. The transverse dimension of the rib forming slot 66 is given by the character H, while the transverse dimension of the web forming slots 70, 72 is given by the character H1.

Typical numerical values of the various dimensions indicated by the alphabetic reference characters on both FIG. 5B and FIG. 6B are as follows:

A=0.028", B=0.040", B1=0.0085",

C=0.020", E=0.0038", F=0.0040",

G=0.0022", H=0.0018", H1=0.0016",

In FIG. 5A the hollow regions 36 communicate with each other through the passages 46 to impart "clover-like" shape to the unitary void in the core. In FIG. 6A the hollow regions 36 are isolated from each other. As discussed in conjunction with FIGS. 2B and 4B, to form such filaments it is necessary merely to modify the distance that the rib-forming slots 66 extends toward the center 58, as denoted by the dimension D. In FIG. 5B the dimension D is 0.010" and the slots 66 occupy less than one-half the distance between the junction point 64 and the central point 58 of the cluster. In FIG. 6B the dimension D=0.0066", and the slots 66 occupy greater than two-thirds the distance between the junction point 64 and the central point 58 of the cluster.

Figure 7A:
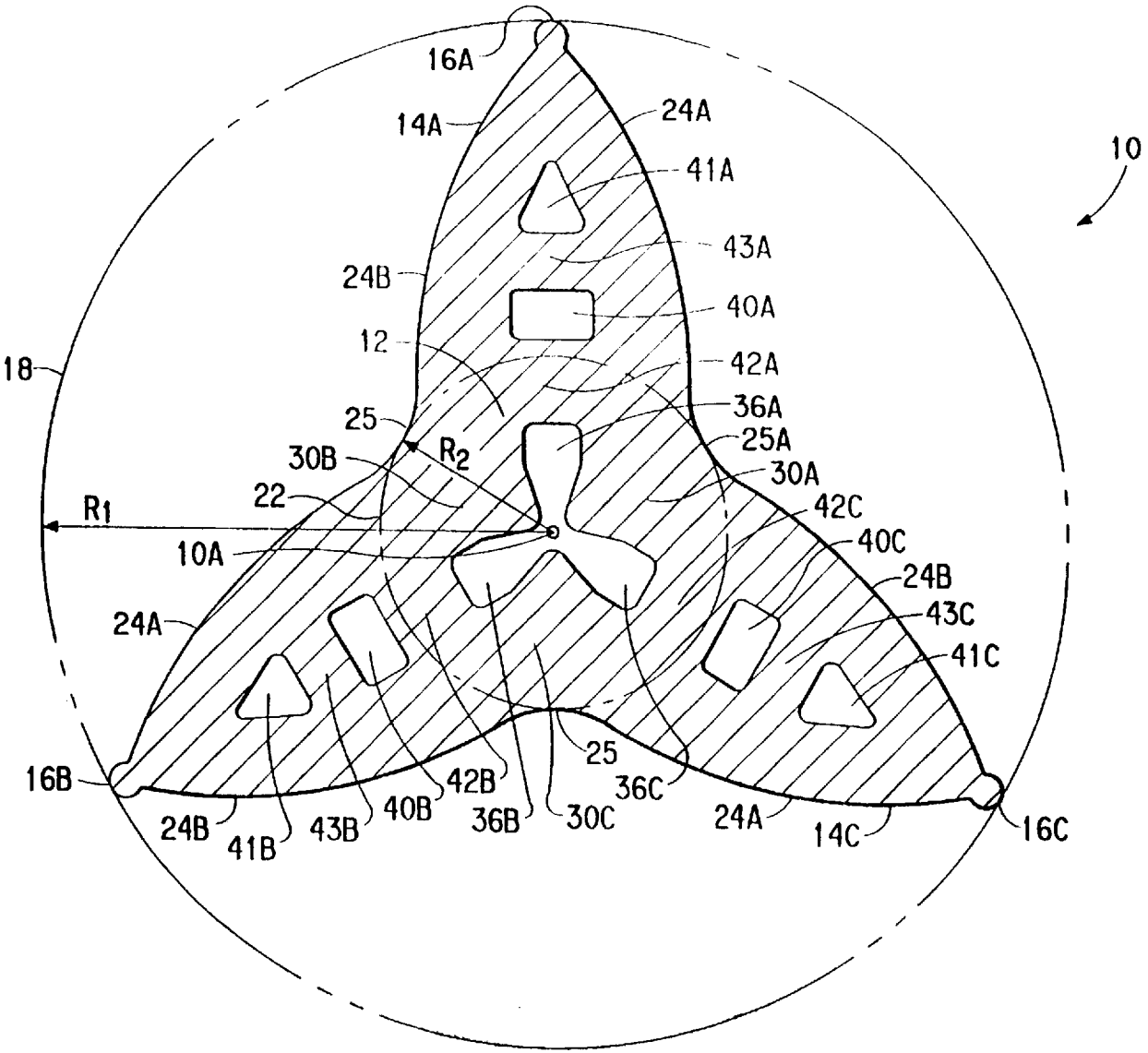
Figure 7B:
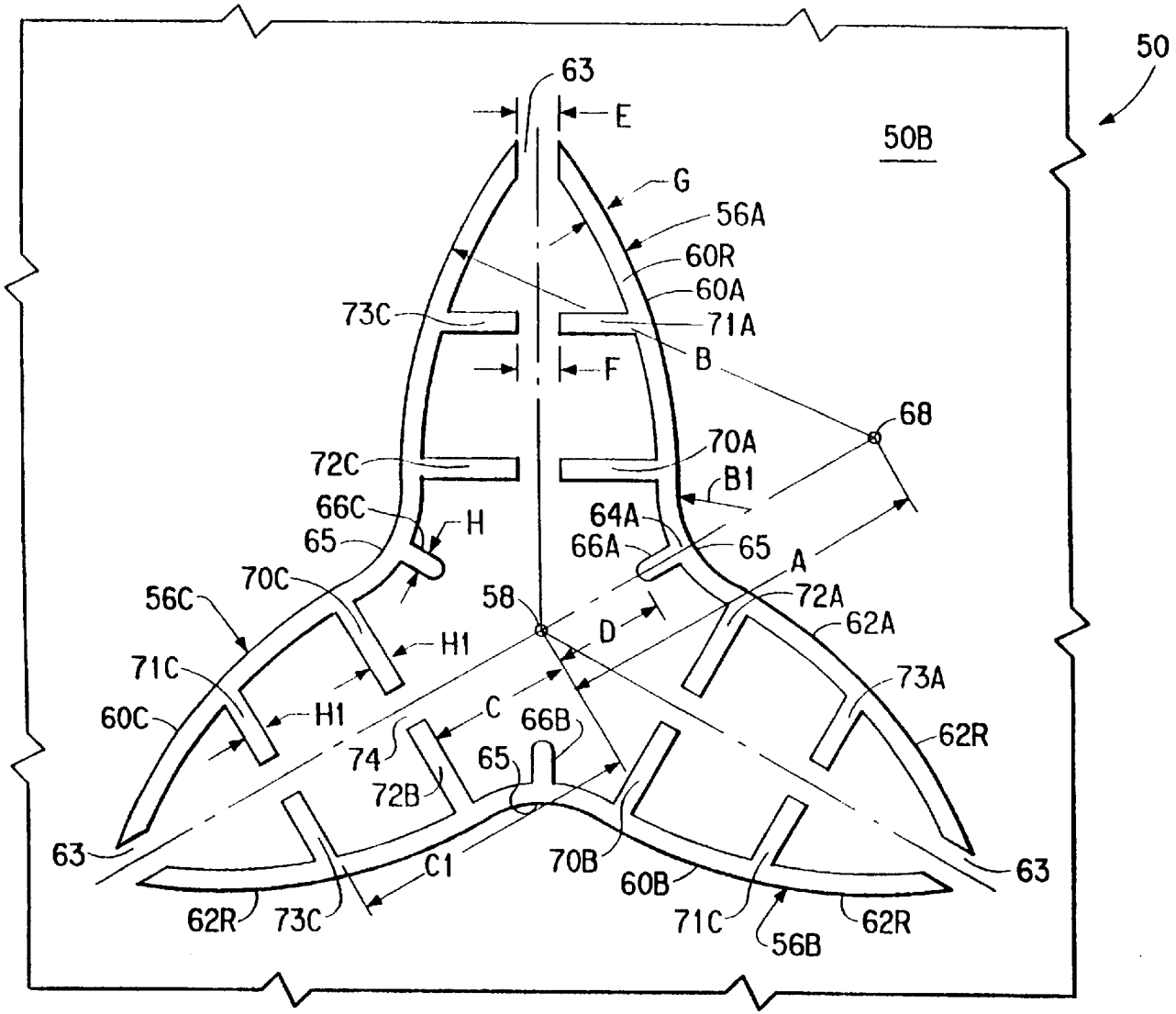
Figure 8A:
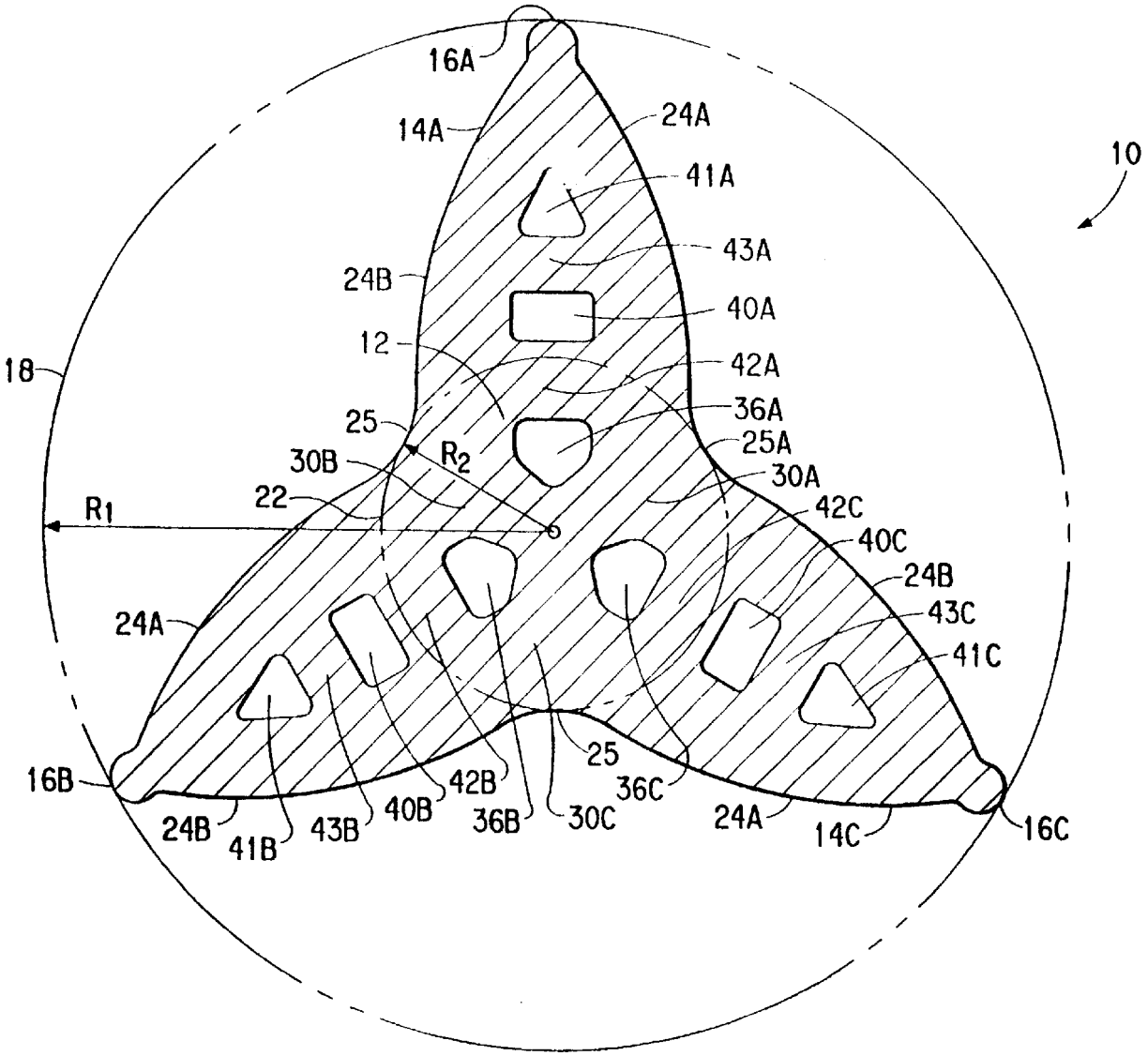
Figure 8B:
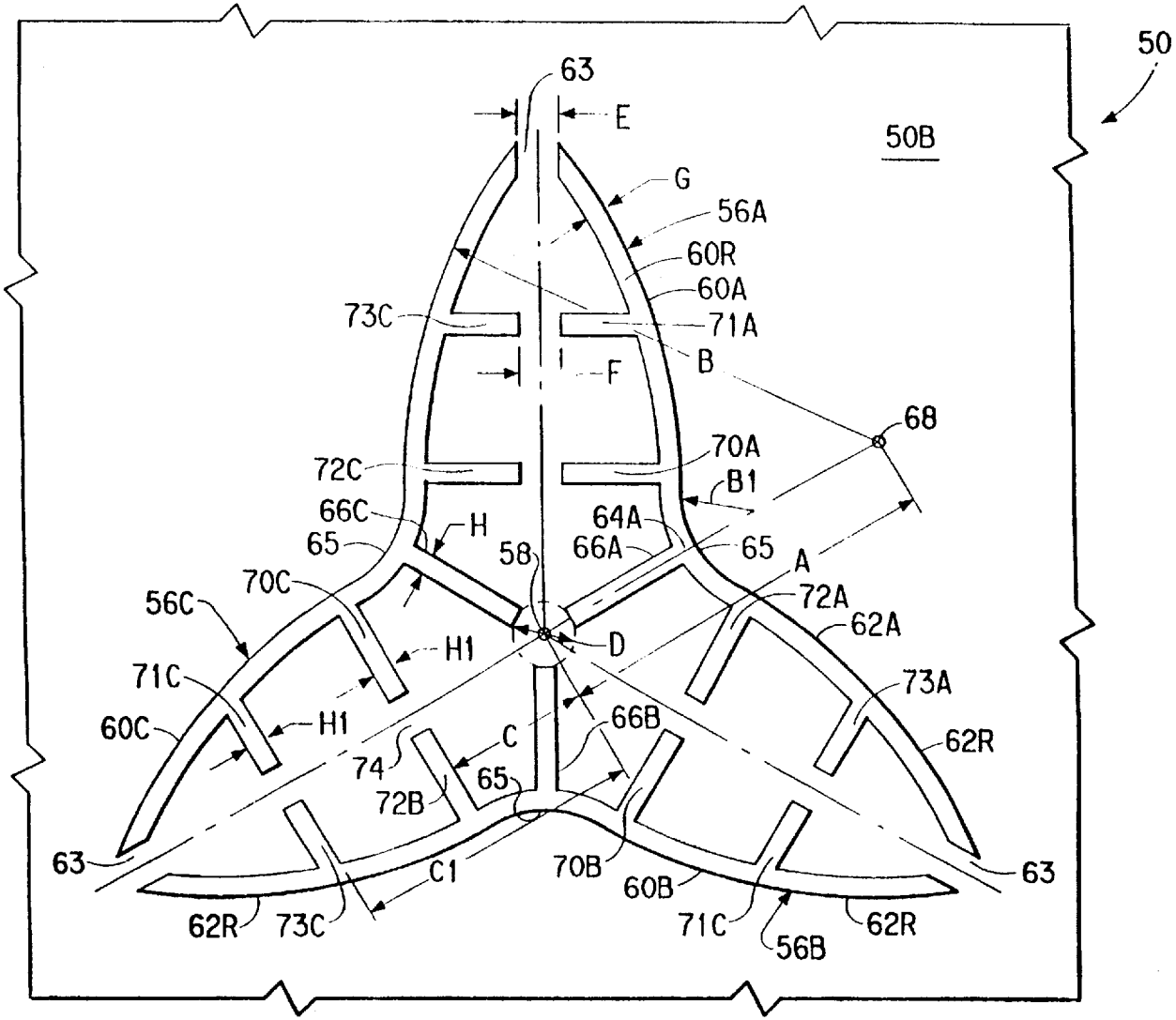

Typical numerical values of the various dimensions indicated by the alphabetic reference characters on both FIG. 7B and FIG. 8B, are as follows:

A=0.048", B1=0.0085", C=0.020", C1=0.039",

E=0.0038", F=0.0040", G=0.0022",

H=0.0018", H1=0.0016

In FIG. 7B the dimension D is 0.095" and the slots 66 occupy less than one-half the distance between the junction point 64 and the central point 58 of the cluster, imparting a clover-like shape to the core region. In FIG. 8B the corresponding dimension D is 0.0066" and the slots 66 extend for greater than two-thirds the distance between the junction point 64 and the central point 58 of the cluster. The ribs 32 (FIG. 8A) join each other.

Figure 11A:
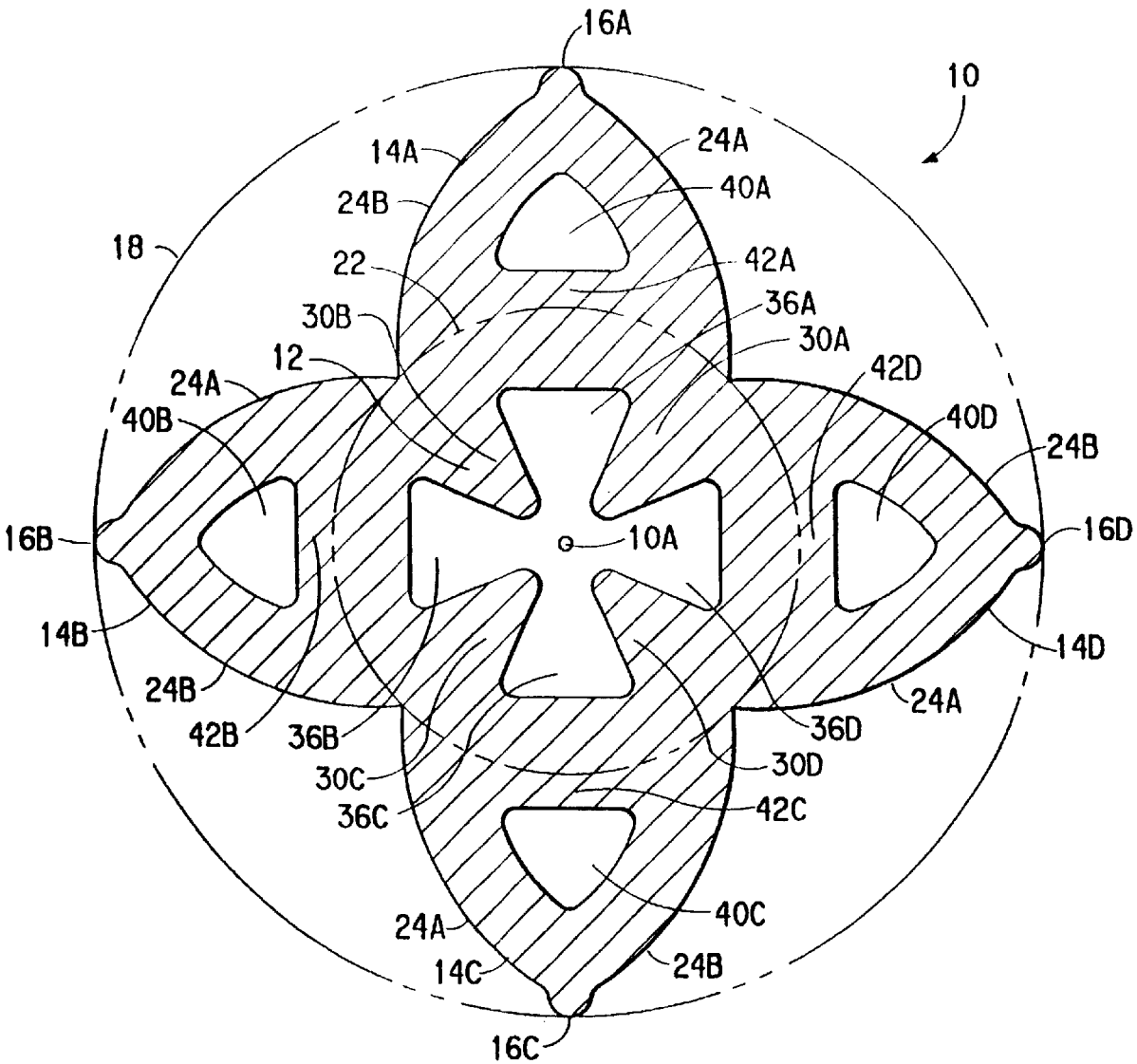
FIG. 11A and FIG. 12A are cross section views analogous to the views shown in FIGS. 5A and 6A, respectively, of tetralobal filaments in which each lobe has convexly curved edges and a single opening therein.
Figure 13A:
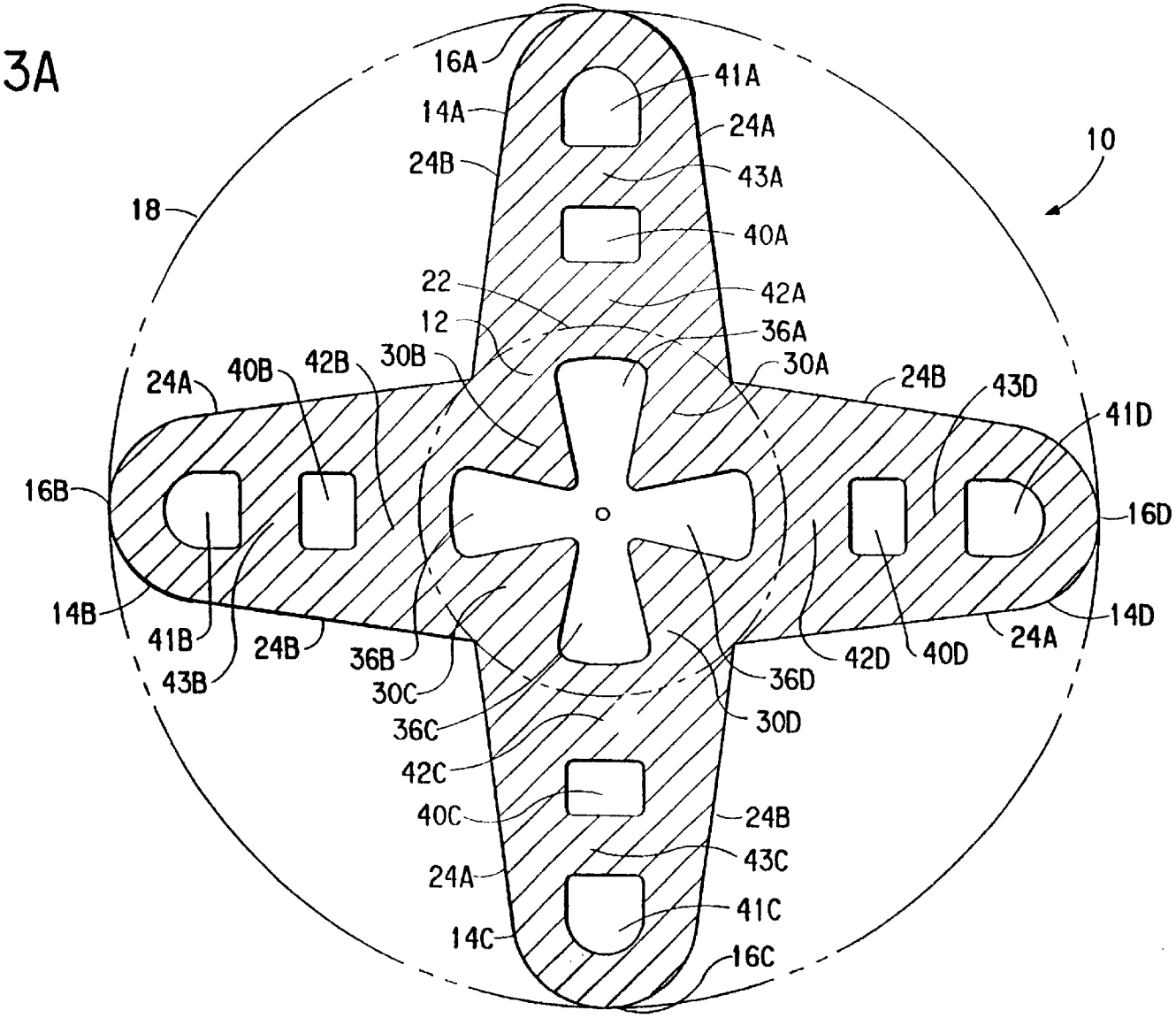
FIG. 13A is a cross section view analogous to the view shown in FIG. 3A showing a tetralobal filament in which each lobe has straight edges with two openings therein, and in which the hollow regions of the core portion communicate through constricted passages defined by the stiffening ribs.
Figure 14A:
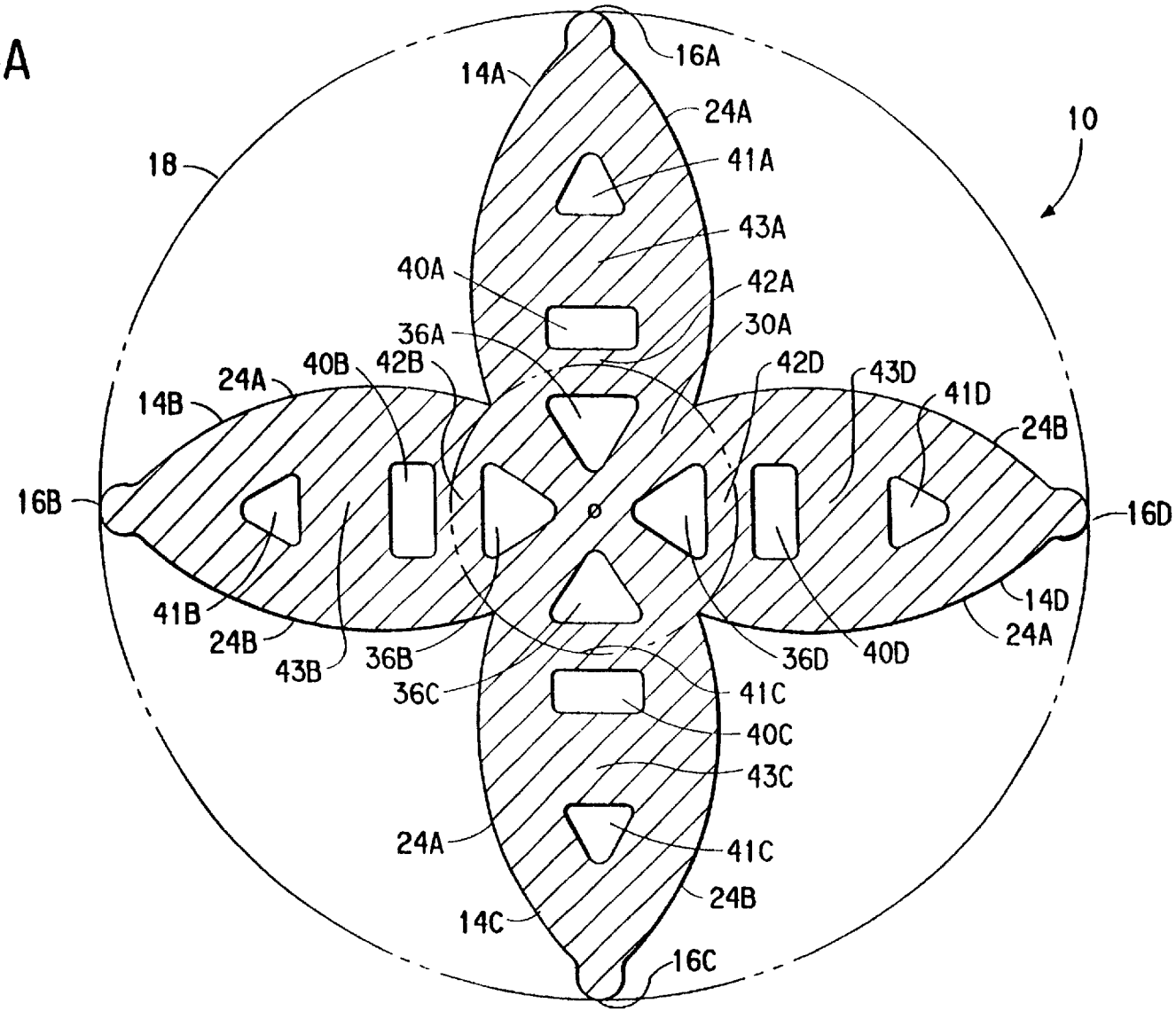
FIG. 14A is a cross section view analogous to the view shown in FIG. 8A showing a tetralobal filament in which each lobe has convexly curved edges with two openings therein, and in which the stiffening ribs connect with each other to isolate the hollow regions defined in the core portion.

FIGS. 1A through 8A illustrates the present invention as applied to a trilobal filament (i. e., the number N is three). However, the present invention may also be implemented in the form of a tetralobal filament (i. e., the number N is four) having four lobes 14A, 14B, 14C and 14D. The lobes may have either straight or convexly curved lateral edges, with either single or double stiffening webs in each lobe, and with either communal or isolated hollow regions in the core. Various embodiments of tetralobal filaments with a single opening in each lobe are shown in FIGS. 9A through 12A. FIGS. 13A and 14A illustrate tetralobal filaments having a pair of openings disposed in each lobe.

Figure 9A:
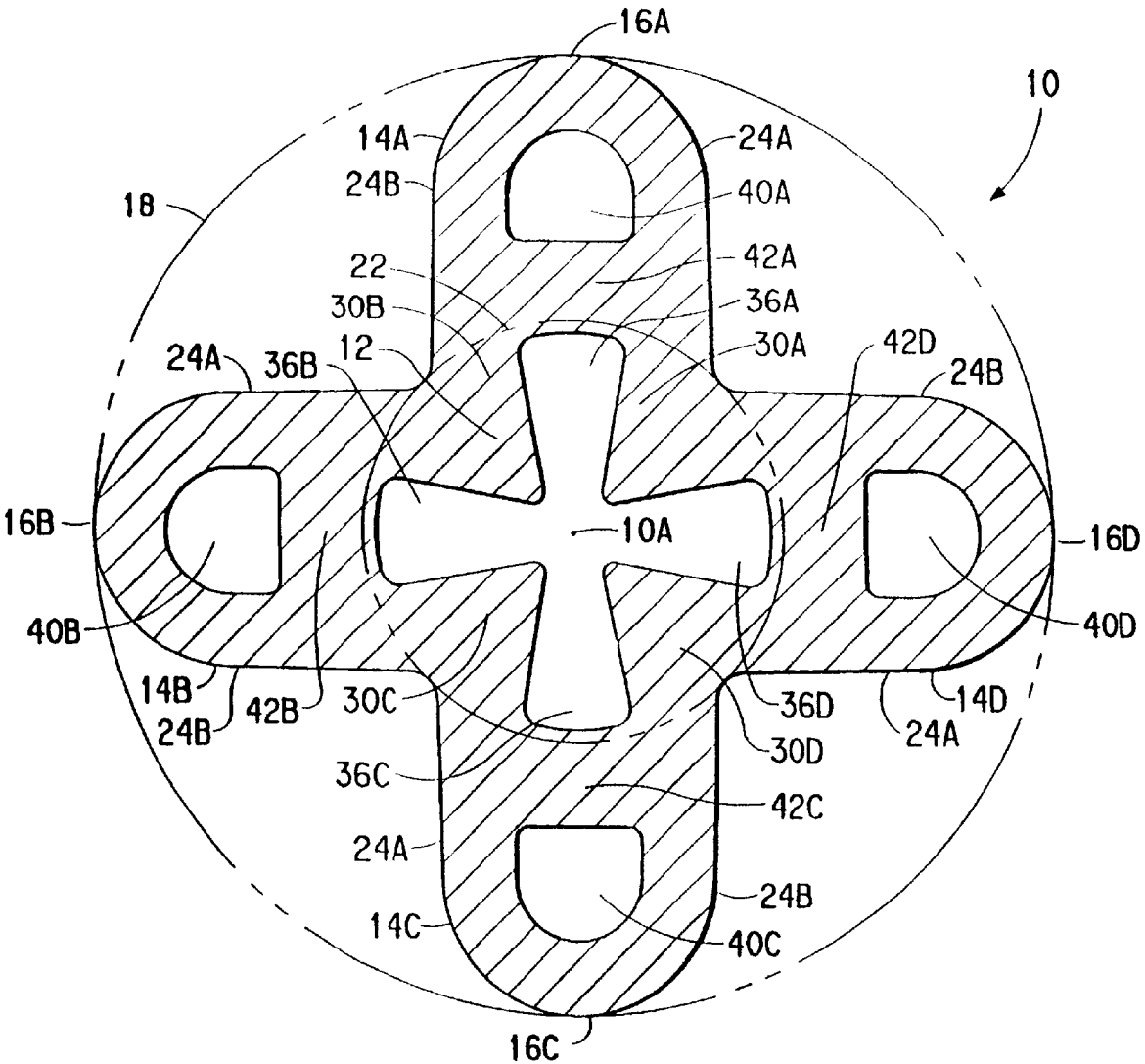
FIG. 9A and FIG. 10A are cross section views analogous to the views shown in FIGS. 1A and 2A, respectively, of tetralobal filaments in which each lobe has straight-edges and a single opening therein.
Figure 10A:
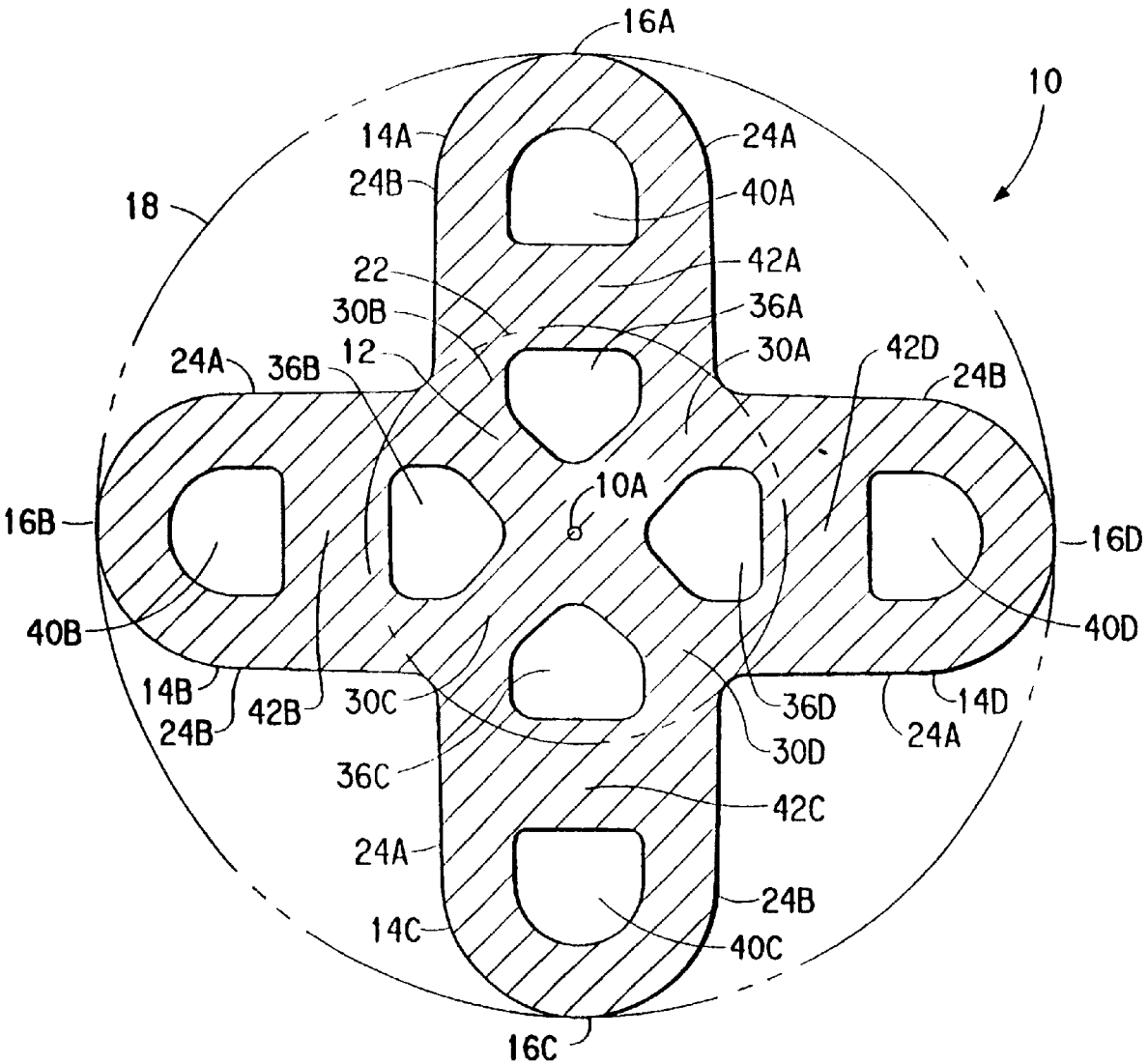

FIGS. 9A and FIG. 10A show straight-edged tetralobal filaments with communicating and isolated hollow regions 36, analogous to the filaments of FIGS. 1A and 2A, respectively. FIG. 11A and FIG. 12A show tetralobal filaments in which each lobe has convexly curved edges, with either communicating or isolated hollow regions 36, analogous to the filaments of FIGS. 5A and 6A, respectively. In the filaments of FIGS. 11A and 12A, the convexly curved edges meet without the presence of the rounded cusp 25 (FIGS. 7A, 8A).

Figure 9B:
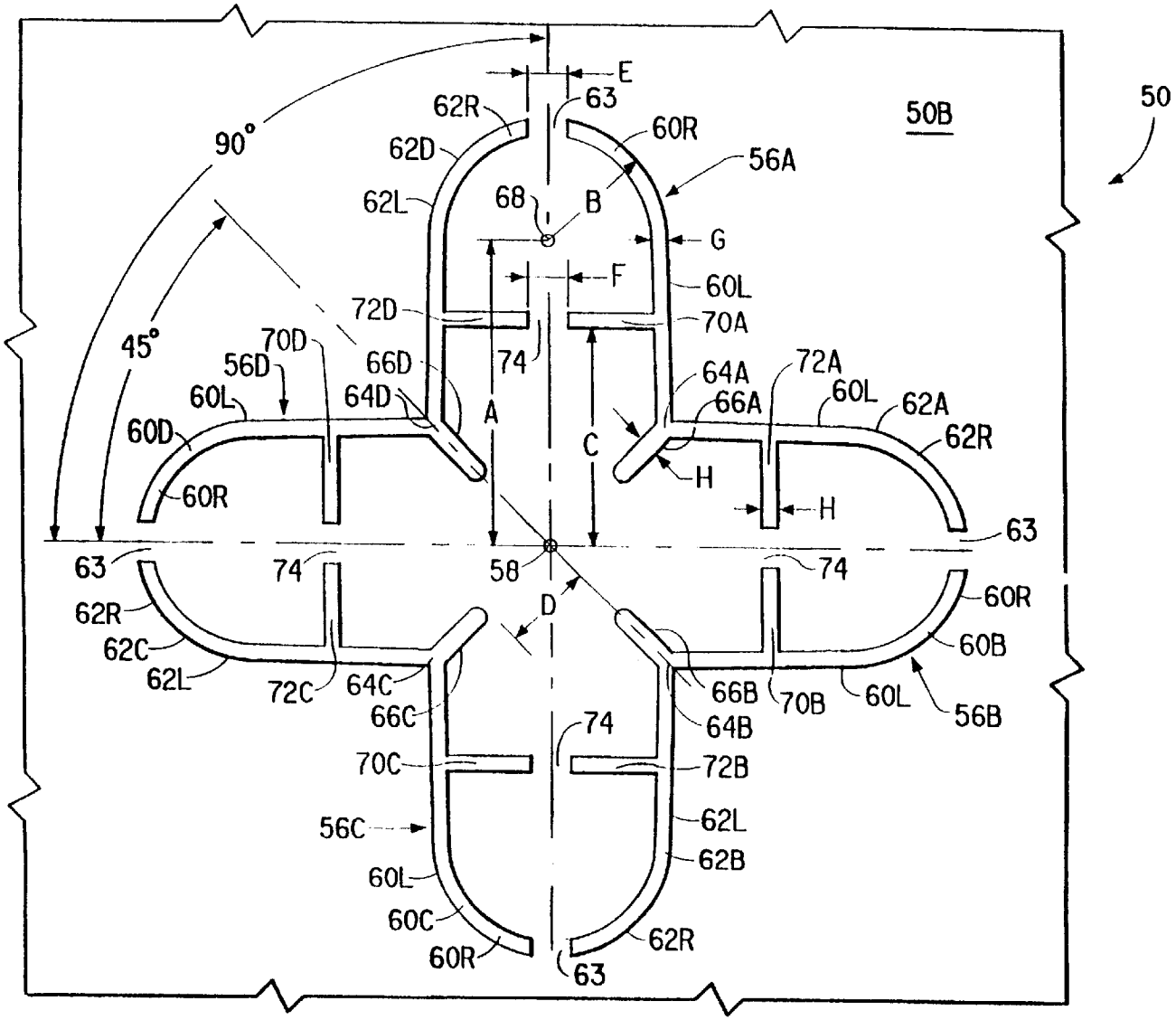
FIG. 9B and FIG. 10B are bottom views of spinneret plates in accordance with the present invention for producing the tetralobal filaments of FIGS. 9A and 10A, respectively.
Figure 10B:
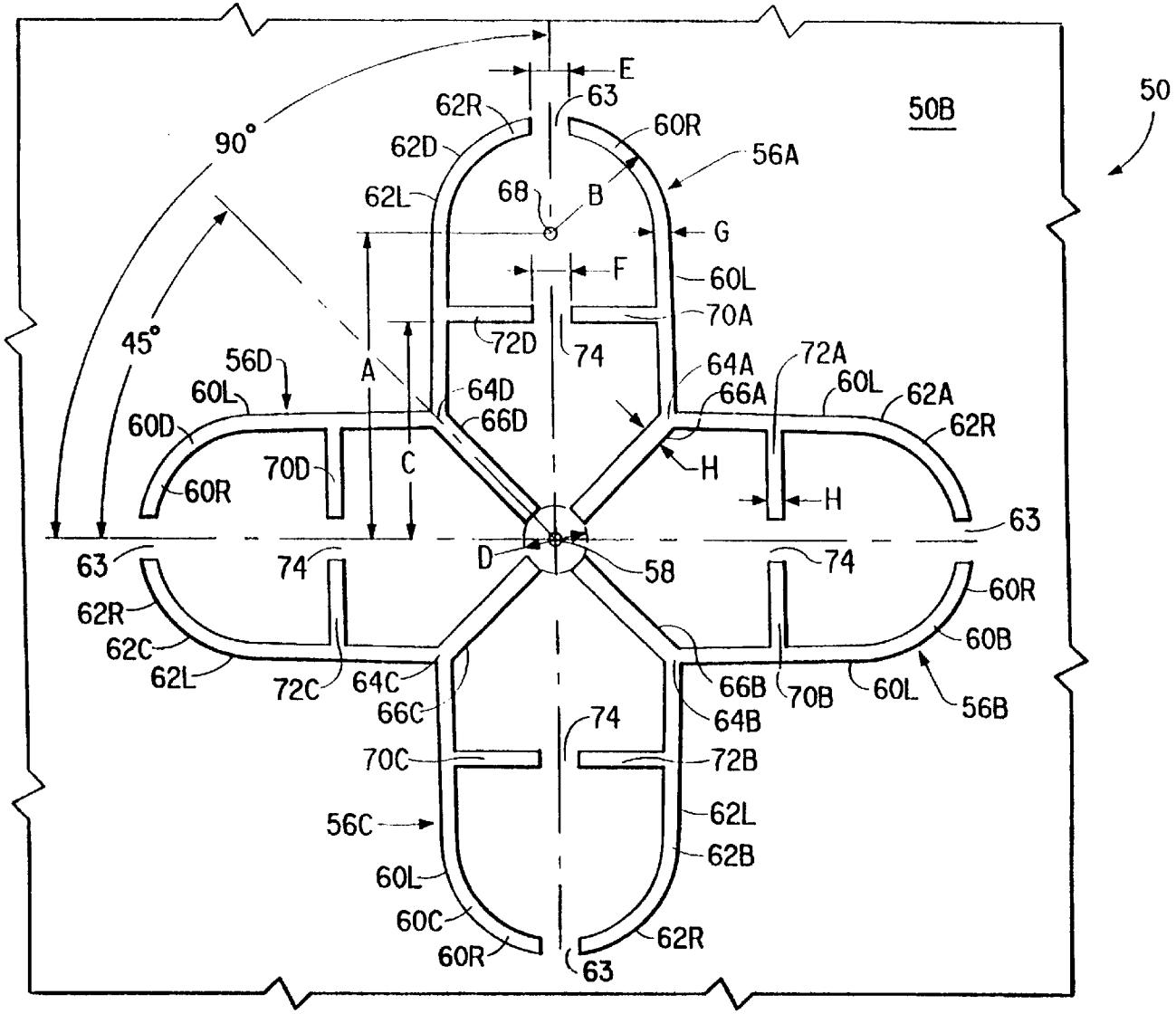
Figure 11B:
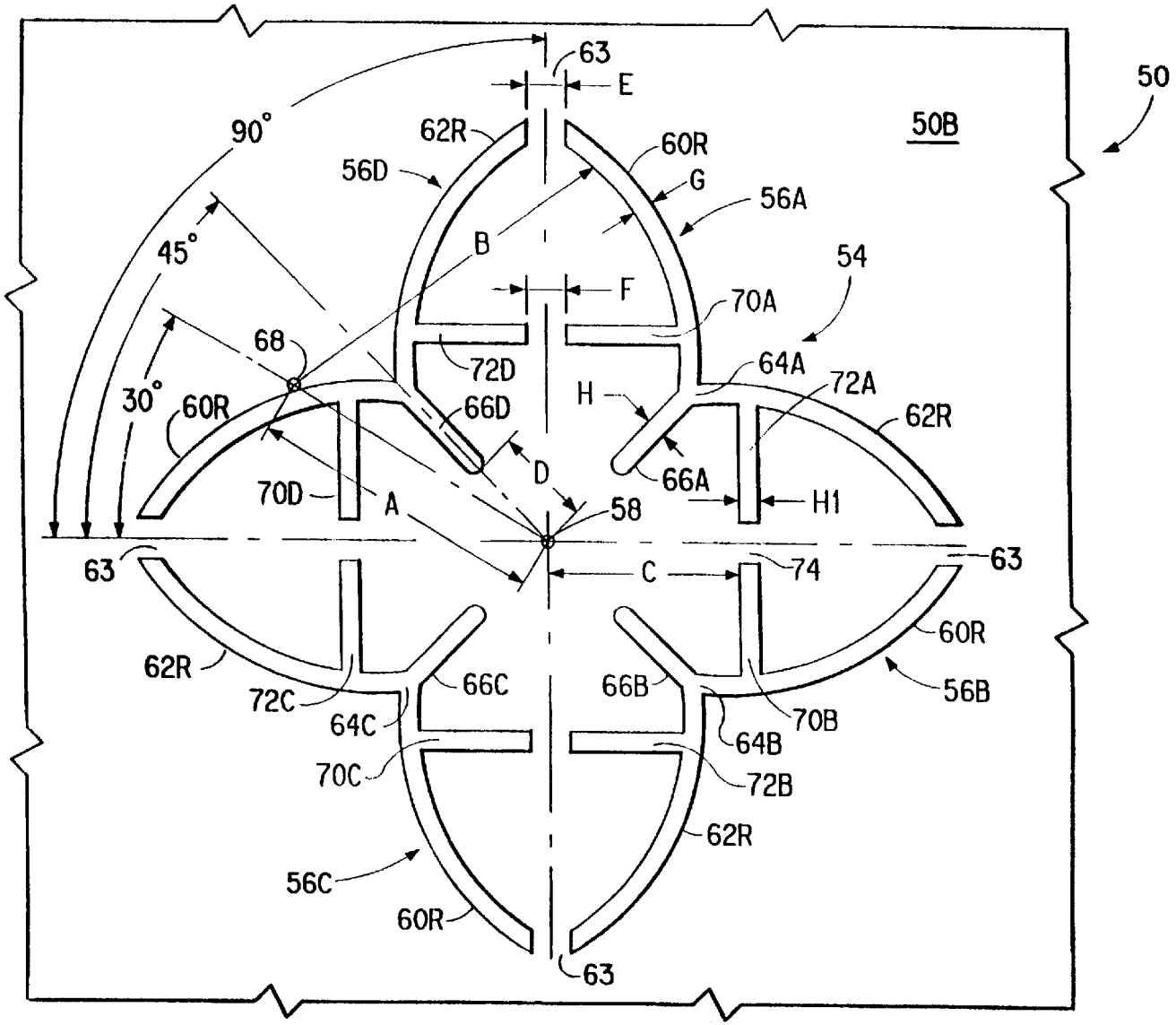
FIG. 11B and FIG. 12B are bottom views of spinneret plates in accordance with the present invention for producing the trilobal filaments of FIGS. 11A and 12A, respectively.
Figure 12A:
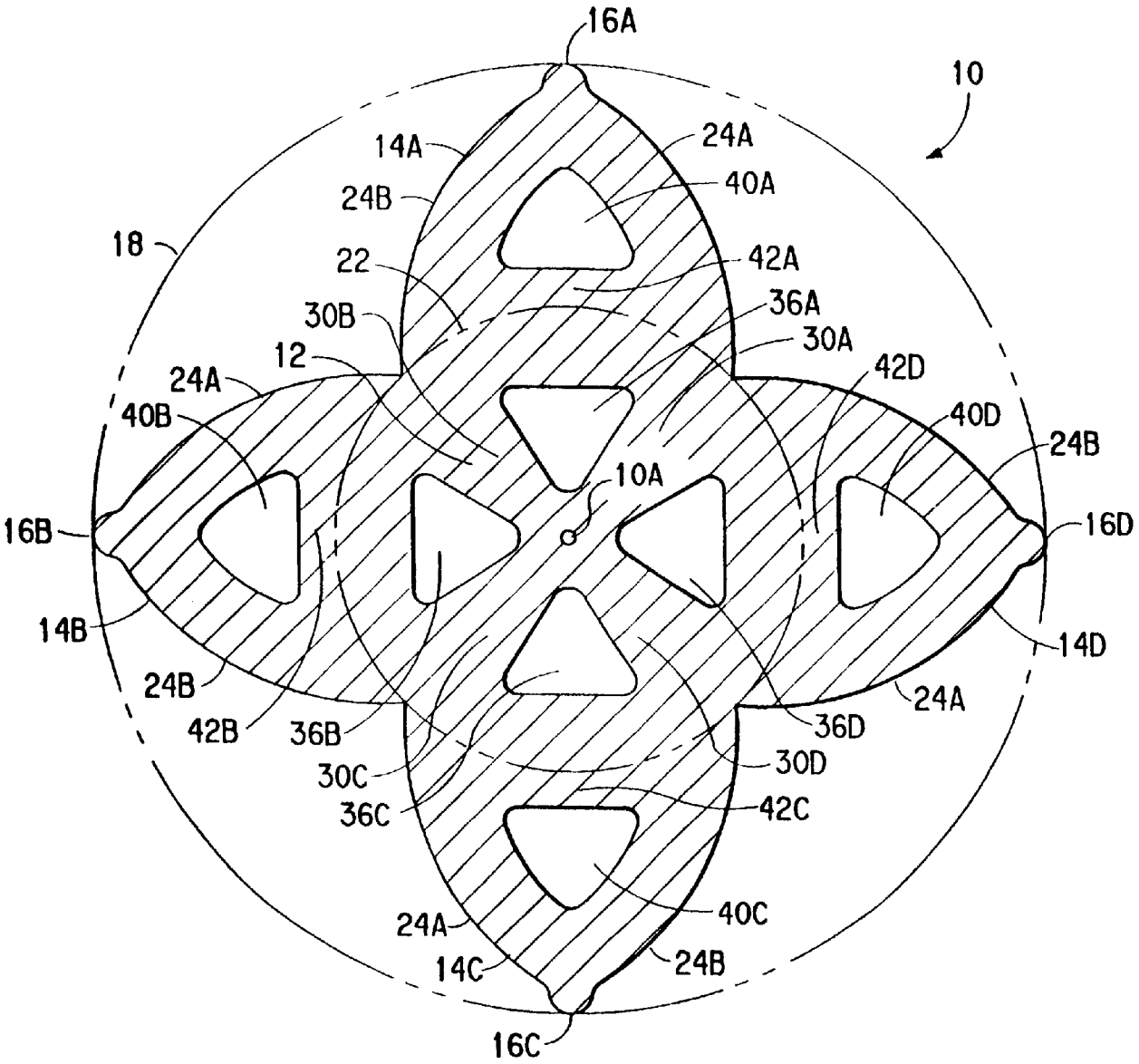
Figure 12B:
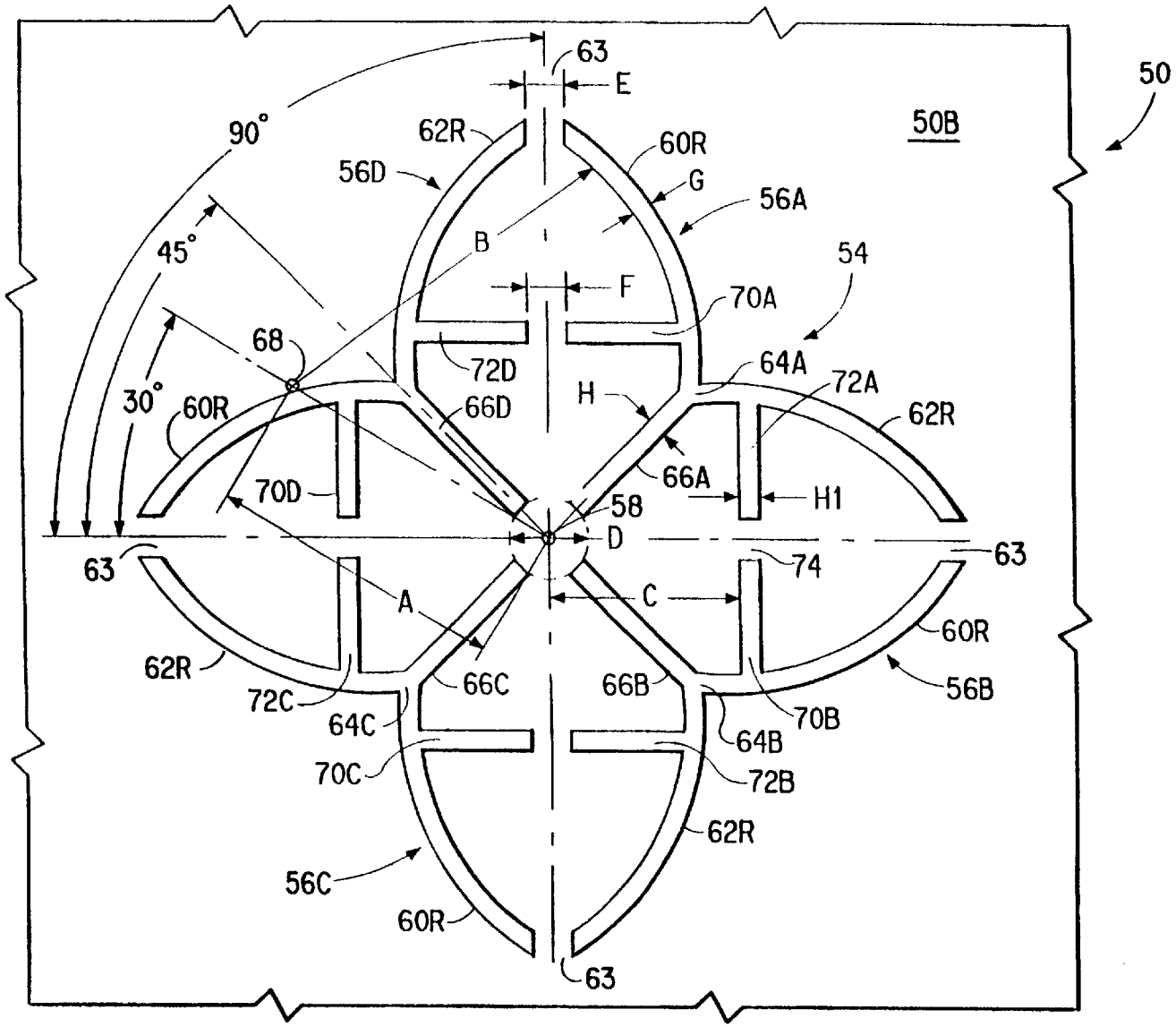

FIGS. 9B, 10B, 11B, 12B respectively show spinnerets for forming the filaments of FIGS. 9A, 10A, 11A, and 12A. Typical dimensions of the spinneret apertures of FIGS. 9B and 10B are respectively the same as those for the spinnerets of FIGS. 1B and 2B. The dimensions of the spinneret apertures for FIG. 11B and FIG. 12B are respectively the same as the dimensions of the spinnerets of FIG. 5B and FIG. 6B.

Figure 13B:
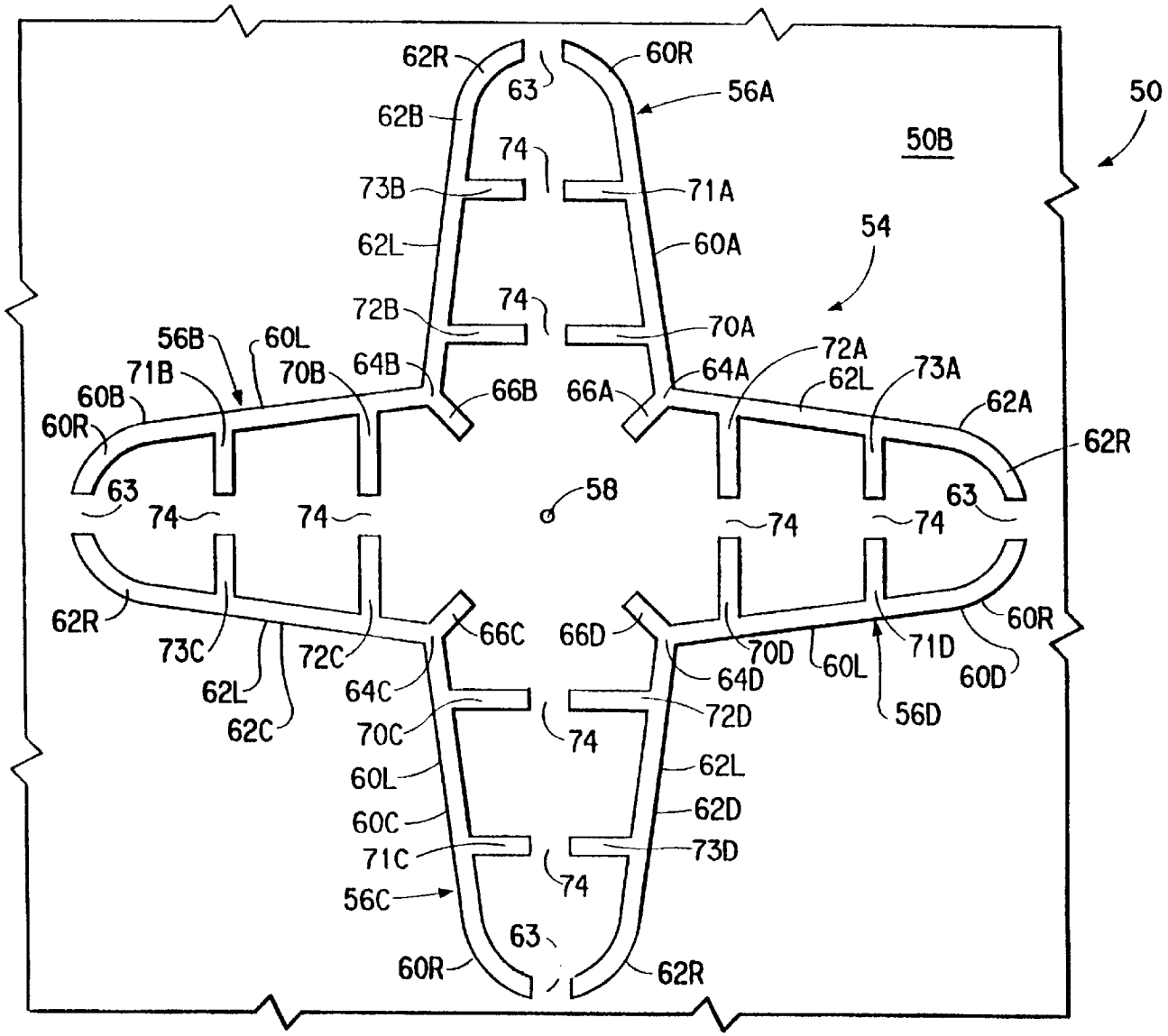
FIG. 13B is a bottom view of a spinneret plate in accordance with the present invention for producing the straight-edged tetralobal filament of FIG. 13A.

FIG. 13A illustrates a straight-edged tetralobal filament produced using a spinneret such as that shown in FIG. 13B. The filament has a pair of openings 40, 41 and a pair of webs 42, 43 in each lobe 14 and communicating hollow regions 36 in the core. Typical numerical values for the various features of the spinneret of FIG. 13B would correspond to those of FIG. 3B. To produce a straight-edged tetralobal filament with isolated hollow regions 36 in the core a spinneret sized and shaped analogously to that shown in FIG. 4B may be used.

Figure 14B:
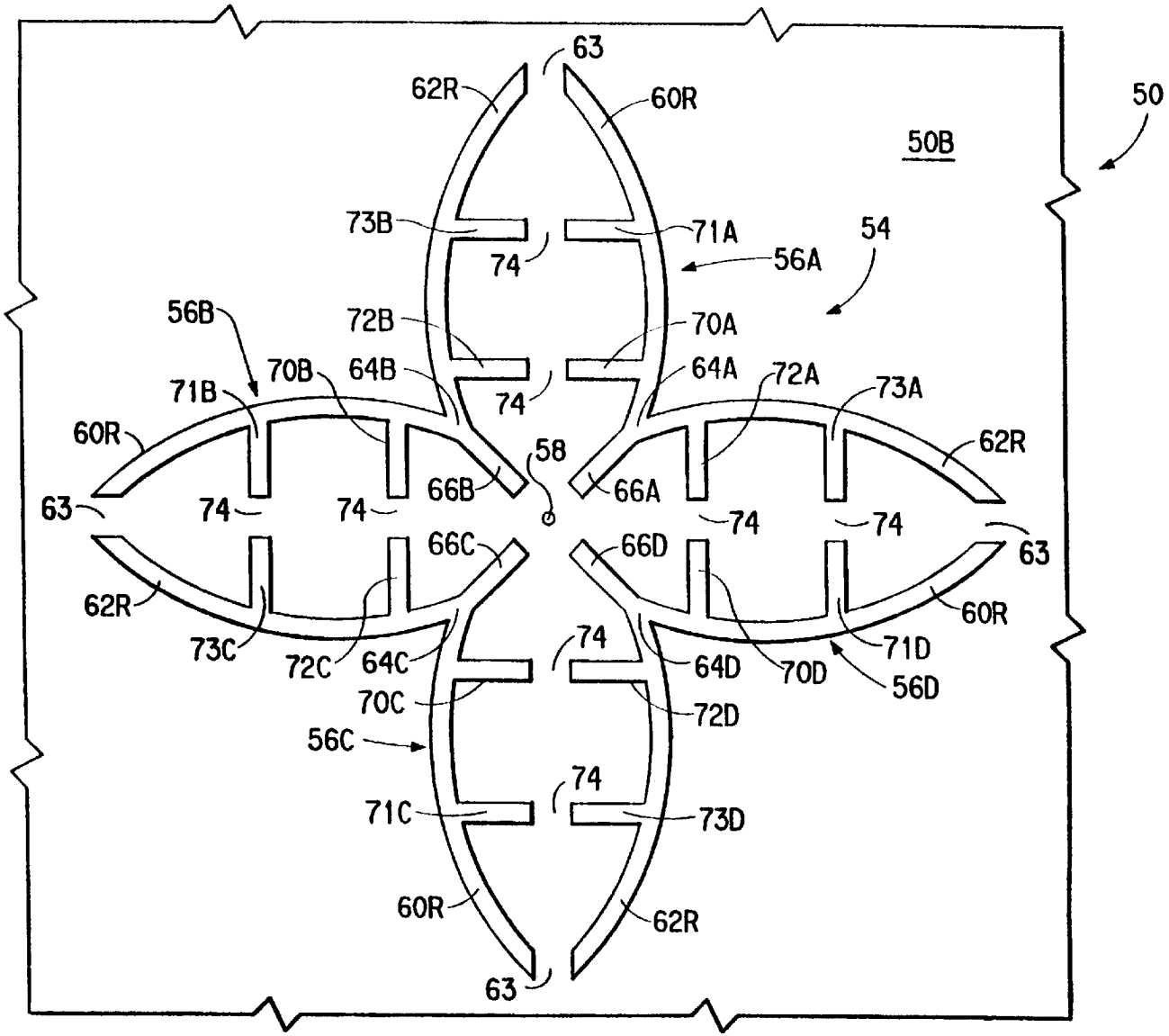
FIG. 14B is a bottom view of a spinneret plate in accordance with the present invention for producing the tetralobal filament having convexly curved edges as shown in FIG. 14A.

FIG. 14A illustrates a tetralobal filament having convexly curved lateral edges. The filament has a pair of openings 40 in each lobe 14 and isolated hollow regions 36 in the core. FIG. 14B illustrates a spinneret which may be used to produce this filament. Typical numerical values for the various features of the spinneret of FIG. 14B would correspond to those of FIG. 8B. A spinneret sized and shaped analogously to that shown in FIG. 7B may be used to produce a convexly curved tetralobal filament with communicating hollow regions 36 in the core.

TESTING METHODS

Luster & Glitter—Yarn

Luster is a property related to the reflection or refraction of parallel or directional light by various interfaces of the fiber. Lower luster corresponds to higher light scattering. Glitter is the property produced when light is reflected or refracted from an area of a fiber which distinguishes that area from its surroundings. It is usually described as a "sparkling" of the fiber. Lower glitter results in a fiber having a luster more like the luster of natural fiber.

The luster and glitter measurements set forth herein (Table 1) for the Comparative and the Example (inventive) yarn samples were obtained from reflectance readings made using a conventional photogoniometer-based luster measurement instrument. A fixed angle of incidence (45 degree) and varied angle of detection were used. Each yarn sample was wound in parallel on a 20 mm×100 mm card and its reflectance measured by the instrument. The half-peak width (HPW) obtained from the recording chart of the instrument is a measure of luster, with a smaller HPW indicating higher luster. The results of this test are listed in Table 1 under the heading "HPW".

The luster and glitter of the Example and Comparative yarn samples were also determined using a subjective visual luster and glitter tests. The samples were irradiated using a high intensity light and viewed by six observers. The yarn sample with highest luster was rated with "5" and the yarn sample with lowest luster rated "1" by each observer. The rating for highest luster therefore was 6×5=30. These ratings are indicated in Table 1 under the heading "Subjective Luster". For glitter a ranking was used, i. e. highest glitter="1", and lowest glitter="5". These ratings are indicated in Table 1 under the heading "Glitter".

Luster & Glitter—Carpet

The luster and glitter measurements set forth herein for carpet samples were obtained from internal reflection readings. The percentage of internal reflection or degree of light scattering inside the fiber is a measure for classifying luster, glitter, and soil hiding. The lower the luster, the lower the glitter and the better the soil hiding capability of the carpet. The "glycol test" was used for measuring the internal reflection of carpet yarns. The reflection from a standard velour, winch dyed #2038A disperse gray, was measured before and after immersion in glycol. In the presence of glycol, reflection from the fiber surfaces is suppressed because of refractive index similarity between glycol and nylon 6,6. The relative reduction of reflection proved to be a reproducible and reliable measure for the percentage external reflection of yarns. The internal refection is calculated subtracting the external reflection from one hundred.

To obtain external reflection, a calorimeter Colorgloss, type of light C/10o is used. The CIE-L* is a numerical value for lightness of a sample from 0–100 (zero=black, 100=white). L*1—value: lightness of the sample measured w/o glycol. L*2—value: lightness of the sample measured in glycol.

$$\text{Percentage external reflection} = \frac{L*1 - L*2}{L*1} \times 100$$

The results of this test are reported in Table 2 under the heading "Internal Reflection".

Glitter of two Test Example samples and two Comparative carpet samples which were both irradiated by a high intensity light was also determined subjective-visually. A ranking system highest glitter="1", and lowest glitter="4" was used. The results of this test are reported in Table 2 under the heading "Glitter".

Carpet Cover

Cover was determined subjectively by ranking the light transmittance through the carpet samples having only a primary backing. The lower the light transmittance the higher the cover or bulk in carpet. The results of this test are reported in Table 2 under the heading "Cover".

Carpet Soiling

Carpet soiling was measured using the "Tetrapod" of four currently popular test methods. These test methods are: (1) Soil hiding-dry; (2) Soil hiding-wet; (3) Soil repellency-dry; and (4) Soil repellency-wet. The results of the carpet soiling properties are reported below in Table 3.

The Tetrapod tests consisted of a series of cylindrical drums each 20 cm. in diameter and 20 cm long. Each drum was rotated about the cylindrical axis on four rollers. Inside the drum was placed a four legged "walker" having rubber "soles" on the end of each leg. The "walker" has a hole in the center into which dirt was placed and was held in position by a sieve. The piece(s) of carpet (total area 19 cm×62 cm) were held against the inside surface of the drum by metal clips. The "walker" was placed inside the drum and the whole rotated at 50 rpm. Over a period of about 10 minutes about three grams of soil fell through the sieve and was distributed evenly over the carpet.

Soil Hiding-Dry

This is the default "Tetrapod" Test and was the only soiling test in common use. Each 19 cm×62 cm carpet sample was tested at a time. The tests lasted 3 hours and 20 minutes (10,000 turns). After this time all the soil has been ground into the carpet. Vacuuming does not alter the carpet appearance so it is usually omitted. Each carpet sample was compared visually against a control piece of carpet which has also been in the drum for 10,000 turns but without dirt. The comparison was done under standard lighting conditions using a gray scale [Deutsche Industrie Norm (hereafter "DIN") 54002].

Results from at least three independent observers were averaged to give a "note" from 1 (dirty) to 5 (clean). Half and quarter "notes" gradations are possible, defining a total of twenty-one possible different "notes".

Soil Hiding-Wet

The principle difference in this test was that the carpet was sprayed with 6 ml of water immediately before placing in the drum. The carpet must be allowed to dry before visual comparison.

Soil Repellency-Dry

In the soil hiding tests the soil has no choice: it ends up in the carpet. The purpose of the soil repellency tests is to give the soil a choice: between one of two carpets, or the vacuum cleaner.

Two different carpet samples, each 31 cm×19 cm, were placed in the drum. The test was run for 10 minutes (500 turns) by which time all the soil has left the reservoir and was on or in the carpet. The carpet was then vacuumed using a upright vacuum cleaner with rotating brush. The vacuum cleaner sold by Nilsfisk as "Nilfisk GS 21" was used. Each tested piece was then compared with an untested piece of the same carpet, using the "note" method described above.

Soil Repellency-Wet

This is similar to the dry test. Each piece of carpet was sprayed with three (3) ml of water immediately before testing. After testing, the samples are allowed to dry overnight before vacuuming.

Carpet Wear

Carpet was measured using (1) the static loading test; (2) the Vetterman drum test; and (3) the Castor chair test.

Static Loading

Static loading was measured according to DIN 54316 using a chair leg test to determine the compression behavior of a carpet sample loaded two hours at a pressure of 2.2 kg/cm$^2$. After a sixty minutes decompression time the remaining compression depth was measured. Original and final carpet pile height gives a rating based on a formula according to DIN 54316. The higher the rating number the better the performance.

Vetterman Drum

Testing the change of the carpet appearance under mechanical loading was done by fixing the carpet sample inside metal drum with an internal diameter of seventy (70) cm according to DIN 54328. The drum was rotated 22,000 revolutions, with the direction of rotation reversed every five minutes. Throughout the rotation a 7.6 kg heavy round steel hall fitted with fourteen rubber studs rolled over the carpet. The judgment or classification of the carpet appearance change is done subjective-visually, with the higher the rating number the better the performance.

Castor Chair

The suitability of a carpet for wear or loading by office roller chairs was tested by the Castor Chair according to DIN 54324. After 5000 and 25,000 turns a subjective-visual classification of the appearance change of the carpet pile takes place according to DIN 54328. The higher the rating number the better the performance of the carpet.

The results of the carpet wear properties are reported below in Table 4.

EXAMPLES

Three embodiments of nylon 6,6 bulked continuous filament ("BCF") yarn in accordance with the present invention ("Test Examples") were produced and compared with two prior art nylon 6,6 bulked continuous filament yarns ("Comparative Examples") having a solid trilobal and a hollow, square cross-section, respectively. The nylon 6,6 polymer used for all of the yarns had a relative viscosity of 75–80 RV, and contained no delustering additives other than $TiO_2$. Identical process conditions for spinning, drawing, and bulking were used for all yarns.

The example yarns in accordance with the present invention were the following:

Test Example 1

A trilobal hollow filament yarn as illustrated in FIG. 2A having sixty-four (64) filaments and 1360 dtex, produced using the spinneret of FIG. 2B.

Test Example 2

A trilobal hollow filament yarn as illustrated in FIG. 1A having sixty-four (64) filaments and 1360 dtex, produced using the spinneret of FIG. 1B.

Test Example 3

A trilobal hollow filament yarn as illustrated in FIG. 6A having sixty-four (64) filaments and 1360 dtex, produced using the spinneret of FIG. 6B.

The comparison yarns were the following:

Comparison A

A trilobal, solid filament yarn having sixty-eight (68) filaments and 1260 dtex such as the yarn sold by E. I. du Pont de Nemours and Company as DuPont 1301-O bright solid trilobal having a modification ratio of 2.6.

Comparison B

A square hollow filament yarn having sixty-four (64) filaments and a linear density of 1360 dtex such as the yarn sold by E. I. du Pont de Nemours and Company as Du Pont 1401-D bright square four-hole cross-section having a percent hollow of 14.6 and a modification ratio of 1.4.

The optical properties of the yarns having a $TiO_2$ content of 0.02% (bright) were determined by the described methods for luster and glitter, and the results are reported below in Table 1.

TABLE 1

| Cand. | MR | Void % | HPW Luster | Subjective Luster | Glitter |
|---|---|---|---|---|---|
| Comp. A | 2.6 | 0 | 6.1 | 30 | 1 |
| Comp. B | 1.4 | 14.6 | 7.8 | 24 | 2 |
| Test Ex. 1 | 2.6 | 14.3 | 9.3 | 12 | 4 |
| Test Ex. 2 | 2.6 | 15.7 | 9.9 | 7 | 5 |
| Test Ex. 3 | 2.6 | 11.5 | 9.0 | 17 | 3 |

Carpet: In order to illustrate the invention concerning optical-, cover/bulk-, mechanical-, and soiling-properties velour carpets of the BCF-yarns with following carpet constructions were made and tested: 68–77 stiches/10 cm, 1/10 inch gauge, 570 g/m2 pile weight, 6 mm pile height. Then #2038A disperse gray, latex and "ActionBac" backing for appearance retention, #9719 acid beige, latex for soiling.

The results of the optical and cover/bulk properties are reported below in Table 2.

TABLE 2

| Cand. | MR | Void % | Internal Reflection | Glitter 1 = High | Cover 1 = High |
|---|---|---|---|---|---|
| Comp. A | 2.6 | 0 | 10.4% | 1 | 4 |
| Comp. B | 1.4 | 14.6 | 53.0 | 2 | 3 |
| Test Ex. 1 | 2.6 | 14.3 | 53.5 | 3 | 2 |
| Test Ex. 2 | 2.6 | 15.7 | 58.5 | 4 | 1 |

TABLE 3

| | | | | Tetrapod Soiling | | | |
|---|---|---|---|---|---|---|---|
| Cand. | MR | Void % | $TiO_2$% | Dry | Dry/ Cleaned | Wet | Wet/ Cleaned |
| Comp. A | 2.6 | 0 | 0.02 | 3.50 | 3.75 | 1.50 | 2.25 |
| Comp. B | 1.4 | 14.6 | 0.02 | 3.50 | 4.00 | 2.25 | 3.00 |
| Test Ex. 1 | 2.60 | 14.3 | 0.02 | 3.25 | 3.75 | 2.00 | 2.75 |
| Test Ex. 2 | 2.60 | 15.7 | 0.02 | 3.50 | 4.00 | 1.75 | 2.50 |

TABLE 4

| Cand. | MR | Void % | $Ti0_2$% | Static Loading | Vetterman Drum | Castor Chair |
|---|---|---|---|---|---|---|
| Comp. A | 2.6 | 0 | 0.02 | 3.6 | 2.0 | 2.3 |
| Comp. B | 1.4 | 14.6 | 0.02 | 3.6 | 2.5 | 2.6 |
| Test Ex. 1 | 2.6 | 14.3 | 0.02 | 3.8 | 2.0 | 2.6 |
| Test Ex. 2 | 2.6 | 15.7 | 0.02 | 3.5 | 2.0 | 2.4 |

RESULTS

The yarn and carpet results shown in Tables 1–4 reveals a significant glitter/luster reduction and improvement in cover of the invented hollow trilobal as against prior art solid trilobal and hollow square cross-section filament or fiber products. Carpet wear and soiling performance of the new hollow trilobal fibers are also better than solid trilobal fibers.

From the foregoing it may be appreciated that the present invention is directed to multi-lobal filaments that reflect light diffusely, resulting in low glitter. Filaments of the present invention exhibit good soil hiding and covering ability without sacrificing crush resistance and without increasing the volume of the polymer material in the fiber. The invention allows the use of less polymeric material, since the void content is higher than in conventional hollow filaments. This results in less material to be processed, disposed of and/or recycled. Such filaments are very suitable for carpets and other textile products which are desired to exhibit high cover, good soiling and durability performance, and natural glitter-free lusters. When used in apparel fabrics, the filaments of the invention provide good heat insulation.

Those skilled in the art, having the teachings of the present invention as hereinbefore set forth may effect numerous modifications thereto. It should be appreciated that such modifications are to be construed within the contemplation of the present invention, as defined by the appended claims.

What is claimed is:

1. A thermoplastic filament having a central axis therethrough, the filament comprising:

a core portion having N lobes joined thereto, each lobe having a tip thereon, each lobe being joined to the core portion along an inscribing circle, the core portion having N stiffening ribs formed therein, the ribs extending radially inwardly toward the axis of the filament, the ribs cooperating to define at least N hollow regions in the core portion, each hollow region aligns radially with a respective lobe, each lobe having at least one opening therein, the opening in each lobe being disposed between the tip of the lobe and the inscribing circle, the opening in each lobe and the hollow region of the core portion corresponding to that lobe cooperating to define a transverse stiffening web extending across the lobe.

2. The filament of claim 1, wherein each stiffening rib has a radially inner end thereon, the radially inner ends of the ribs being spaced from each other and from the central axis of the filament thereby to define passages within the core portion through which the hollow region communicate with each other.

3. The filament of claim 1, wherein each stiffening rib is connected to the other of the ribs along the axis of the filament, whereby the hollow regions are isolated from each other.

4. The filament of claim 1, wherein each lobe has at least a second opening therein, the second opening in each lobe being disposed between the first opening and the tip of the lobe, the first and the second openings in each lobe cooperating to define a second transverse web extending across the lobe.

5. The filament of claim 3, wherein each lobe has at least a second opening therein, the second opening in each lobe being disposed between the first opening and the tip of the lobe, the first and the second openings in each lobe cooperating to define a second transverse web extending across the lobe.

6. The filament of claim 2, wherein each lobe has at least a second opening therein, the second opening in each lobe being disposed between the first opening and the tip of the lobe, the first and the second openings in each lobe cooperating to define a second transverse web extending across the lobe.

7. The filament of claim 1, wherein each lobe has a first and a second lateral edge, the major portion of each lateral edge being substantially linear over substantially its entire length.

8. The filament of claim 1, wherein each lobe has a first and a second lateral edge, the major portion of each lateral edge is convexly curved over substantially its entire length.

* * * * *